US010988284B2

(12) United States Patent
Bantug et al.

(10) Patent No.: US 10,988,284 B2
(45) Date of Patent: Apr. 27, 2021

(54) VIAL SLEEVE ASSEMBLY

(71) Applicant: AMGEN INC., Thousand Oaks, CA (US)

(72) Inventors: Anthony Bantug, Woodland Hills, CA (US); Wael Mismar, Redondo Beach, CA (US); Kenneth Tan, Canoga Park, CA (US); Tark Abed, Mountain View, CA (US); Justin Allen Marsh, San Mateo, CA (US); Mario Bogdan, Palo Alto, CA (US); Scott Comiso, Menlo Park, CA (US); Brian Schryver, Redwood City, CA (US)

(73) Assignee: AMGEN INC., Thousand Oaks, CA (US)

( * ) Notice: Subject to any disclaimer, the term of this patent is extended or adjusted under 35 U.S.C. 154(b) by 87 days.

(21) Appl. No.: 16/091,129

(22) PCT Filed: May 12, 2017

(86) PCT No.: PCT/US2017/032336
§ 371 (c)(1),
(2) Date: Oct. 4, 2018

(87) PCT Pub. No.: WO2017/197222
PCT Pub. Date: Nov. 16, 2017

(65) Prior Publication Data

US 2019/0152650 A1 May 23, 2019

Related U.S. Application Data

(60) Provisional application No. 62/336,242, filed on May 13, 2016.

(51) Int. Cl.
*B65D 23/08* (2006.01)
*A61J 1/16* (2006.01)

(52) U.S. Cl.
CPC ..... *B65D 23/0885* (2013.01); *A61J 1/16* (2013.01); *A61J 2205/20* (2013.01); *A61J 2205/30* (2013.01)

(58) Field of Classification Search
CPC ..... B65D 23/0885; B65D 81/3876; B65D 81/3879; B65D 41/0442; A47G 23/0241;
(Continued)

(56) References Cited

U.S. PATENT DOCUMENTS 3,285,455 A * 11/1966 Pewitt ..... B65D 81/3879 215/395
3,346,135 A * 10/1967 Haitsch ..... B65D 51/26 215/227
(Continued)

FOREIGN PATENT DOCUMENTS

FR 2338722 A1 8/1977
FR 2388722 A1 11/1978
WO WO-2007067766 A1 6/2007

OTHER PUBLICATIONS

International Search Report for International Application No. PCT/US2017/032336, dated Sep. 18, 2017.

*Primary Examiner* — Shawn M Braden
(74) *Attorney, Agent, or Firm* — Marshall, Gerstein & Borun LLP

(57) ABSTRACT

A sleeve for securing a cryogenic vial includes a cylindrical body sized to receive a vial, the body including a longitudinal axis, a first end, and a second end. A plurality of deformable members are disposed near the first end of the body and are arranged to deform from a first configuration to a second configuration. Each deformable member is displaced outwardly relative to the longitudinal axis of the body in the second configuration.

20 Claims, 27 Drawing Sheets

(58) Field of Classification Search
CPC ..... Y10S 220/903; Y10S 220/902; A61J 1/16; A61J 2205/20; A61J 2205/30
USPC ..... 215/395
See application file for complete search history.

(56) References Cited

U.S. PATENT DOCUMENTS

| | | | | | |
|---|---|---|---|---|---|
| 4,299,100 | A * | 11/1981 | Crisman | B65D 81/3883 | 220/592.17 |
| 4,870,837 | A * | 10/1989 | Weins | B65D 81/3883 | 62/457.4 |
| 5,862,937 | A * | 1/1999 | Carrizales | F25D 31/007 | 206/5 |
| 2009/0230082 | A1 * | 9/2009 | Dickerson | B65D 23/12 | 215/395 |
| 2013/0340230 | A1 * | 12/2013 | Salman | B65D 23/12 | 29/428 |

* cited by examiner

VIAL SLEEVE ASSEMBLY

CROSS-REFERENCE TO RELATED APPLICATIONS

This is the United States national phase of International Patent Application No. PCT/US17/32336, filed May 12, 2017, which claims priority to U.S. Provisional Application 62/336,242, filed on May 13, 2016, the entire contents of each of which are hereby incorporated herein by reference.

FIELD OF THE DISCLOSURE

The present disclosure is directed to a sleeve for a vial, and more particularly, to a sleeve for securing to a vial.

BACKGROUND

Many industrial, commercial, and research processes require, for optimal results, that an object or material be maintained at a low temperature. For example, cryogenic preservation or maintenance at low temperature is a common means of insuring the molecular integrity of specimens and products. Substances that would degrade in a relatively short interval at higher temperatures can be stored with limited or no change for long durations at temperatures below the material freezing point.

However, maintenance of a vial that contains a particular specimen or product at a low temperature, such as, for example, below negative 80 degrees C., may make labeling of the vial difficult. In some instances, it is difficult to ensure that a label is easily and permanently affixed to the vial at the low temperature. The label may be important for identifying the specimen or product, such as, for example, a drug, contained within the vial.

In a blinded study, it is also important that a doctor and/or a patient be unaware of what drug the doctor is administering to the patient to ensure that the results of the study are not affected by a placebo effect. Oftentimes a label on a vial will be covered in order to prevent the doctor and/or the patient from knowing what is contained in the vial. However, it may be difficult to ensure the label and covering have not been tampered with in order to view drug information on the label.

SUMMARY

The present disclosure relates generally to a sleeve for securing a vial, as well as related systems and methods. In some embodiments, the vial may contain contents, such as, for example, a specimen and/or a product. In some embodiments, the vial may include a cryogenic vial that may be maintained under cryogenic conditions, for example a temperature at or less than negative 80 degrees C.

In accordance with a first aspect, a sleeve for securing a vial may include a cylindrical body sized to receive a vial, the body including a longitudinal axis, a first end, and a second end. A deformable member disposed near the first end of the body may be arranged to deform from a first configuration to a second configuration. The deformable member may be displaced outwardly relative to the longitudinal axis of the body in the second configuration.

In accordance with a second aspect, a sleeve assembly for securing a vial may include a sleeve configured to receive the vial, wherein an inner surface of the sleeve is cylindrical. A compressible element may be configured to be placed around a neck of the vial, wherein the compressible element is configured in a shape of a partial ring and includes a first end and a second end.

In accordance with a third aspect, a vial and sleeve assembly may include a vial including a top portion, a bottom portion having a reservoir, a neck connected to the top portion, and a shoulder connecting the neck to the bottom portion. A sleeve may include a cylindrical body sized to receive the bottom portion of vial, the body including a longitudinal axis, a first end, and a second end, the sleeve being adapted to removably connect to the vial. A deformable member may be disposed near the first end of the body and arranged to deform from a first configuration to a second configuration. The deformable member may be displaced outwardly relative to the longitudinal axis of the body in the second configuration, the deformable member being adapted to engage with the vial.

In accordance with a fourth aspect, a system for securing a vial may include a vial having a top portion, a bottom portion, a neck between the top portion and the bottom portion, and a shoulder portion between the neck and the bottom portion. A compressible element may include a flange portion, a ledge extending outwardly from the flange portion, and an extension extending downwardly from the ledge. The compressible element may be a partial ring and configured to be placed around the shoulder of the vial. A sleeve may include an opening, an inner surface, and a groove disposed in the inner surface. The opening may be sized to receive the vial and the groove sized to receive the compressible element. When the vial and the compressible element is fully inserted into the sleeve, the flange portion may contact the shoulder of the vial, the ledge may contact the upper edge of the sleeve, and the protrusion of the extension aligns with the groove in disposed in the inner surface, trapping the vial within the sleeve.

In accordance with a fifth aspect, a method for labeling a vial under cryogenic conditions may include inserting a cryogenically frozen vial into an opening of a sleeve having a body comprising a cylindrical inner surface configured to receive a lower portion of the vial.

In further accordance with any one or more of the foregoing first, second, third, and aspects and method, the sleeve, sleeve assembly, system, and method may include any one or more of the following forms or method steps.

In one form of the sleeve, the deformable member may include a finger, a tip, and a bent knuckle portion connecting the finger and the tip. The finger may extend upward from the first end of the cylindrical body and the tip angled inwardly relative to the longitudinal axis of the cylindrical body. The tip and finger may form a hook oriented inwardly relative to the longitudinal axis.

In one form of the sleeve, the finger may flex outwardly relative to the longitudinal axis when the deformable member is in the second configuration.

In one form of the sleeve, the tip may flex inwardly and may pivot about the knuckle toward an inner surface of the cylindrical body when the deformable member is in the second configuration.

In one form, the sleeve may include a flange attached to the cylindrical body at the first end of the body. The flange may define an opening at the first end of the body that is sized to receive the vial.

In one form of the sleeve, the deformable member may be an indentation formed in the body and adapted to engage a neck portion of the vial when the vial is fully inserted into the body.

In one form of the sleeve, the indentation may extend inwardly relative to the longitudinal axis of the body when the deformable member is in the first configuration In one form, the sleeve may include a deformable member disposed near the bottom end of the body.

In one form of the sleeve, the deformable member may be disposed between the first end and the second end of the body.

In one form, the sleeve may include a plurality of deformable members disposed near the first end of the body. The plurality of deformable members may be arranged to engage a shoulder portion of the vial when the vial is fully inserted into the body.

In one form of the sleeve, the deformable member may be integrally formed in the cylindrical body.

In one form of the sleeve, the second end of the body may be partially open.

In one form of the sleeve, the body may include a cylindrical inner surface configured to receive a lower portion of the vial.

In one form of the sleeve, the body may include a cylindrical outer surface.

In one form, the sleeve may include a plurality of fingers evenly spaced apart from each other. Prior to insertion of the vial into the sleeve, each of the plurality of fingers may be disposed in the first configuration. In response to the vial being partially inserted into the body, each of the plurality of fingers may be biased outwardly to the second configuration. In response to the vial being fully inserted into the body, each of the plurality of fingers may be configured to resiliently return to the first configuration, contacting a shoulder of the vial and trapping the vial within the body.

In one form, the sleeve may include a closed bottom of the body such that the vial may not exit the bottom of the body.

In one form, the bent knuckle portion may include a bend angle of less than 90 degrees.

In one form of the sleeve, the inner and outer surface of the sleeve may form a wall, wherein the inner surface is cylindrical. A plurality of indents may be disposed in the wall, and each of the plurality indents may be formed by a portion of the wall pushed inwardly towards the longitudinal axis, or a center, of the body. Each of the plurality of indents may be spaced apart from the wall along a length of the corresponding indent. Each of the plurality of indents may include a width corresponding to a neck of the vial disposed between a shoulder of the vial and an outwardly protruding top of the vial.

In one form of the sleeve assembly, the vial may include a lower portion, a shoulder, a neck, and an outwardly protruding top. The top may be sealed with a cap, which may at least partially cover a septum.

In one form of the system, the inner surface of the sleeve may include a groove extending around all or a portion of an inner circumference of the sleeve. A flange may extend outwardly from an outer side surface of the compressible element in a horizontal plane, wherein the compressible element may be configured to compress to fit inside an upper portion of the sleeve and to decompress in response to the flange aligning with the groove. The flange may be configured to contact an upper portion of the groove when the flange is aligned with the groove.

In one form of the system, an upper surface of the compressible element may be disposed in another horizontal plane, wherein the compressible element may further include a lower surface opposite the upper surface and disposed at an angle with respect to the upper surface. The lower surface may be configured to contact a shoulder of the vial when the flange is aligned with the groove. The upper surface may be configured to contact a bottom surface of a top portion of the vial (or a portion of the cap extending over the bottom surface of the top portion of the vial) when the flange is aligned with the groove.

In one form of the system, an outer surface of the sleeve may include an outer flange that may extend around a portion of an outer circumference of the sleeve. The outer flange may include a collar that extends around an entire outer circumference of the sleeve. The outer flange may extend to a top of the sleeve and may be configured to engage with a device, such as, for example, a closed system transfer device ("CSTD").

In one form of the system, the outer flange may extend around a top portion of the sleeve.

In one form of the system, the CSTD may be used for safe transfer of potentially hazardous contents of the vial and/or may prevent needle sticks. The CSTD may provide a means to make transfers between vials, syringes, and IV bags without exposing the health care professional to the contents. An example of a CSTD may include the PHASEAL™ CSTD commercially available from Becton, Dickinson, and Company.

In one form of the system, the first end of the compressible element may include a first protrusion and the second end may include a second protrusion. The wall of the sleeve may include a slot. Prior to insertion of the compressible element into the slot, the first and second ends may be disposed in a first position. In response to the compressible element being partially inserted into the slot, the inner surface of the sleeve may be configured to press the first and second ends inwardly into a second position. In response to the compressible element being fully inserted into the slot and the first and second protrusions aligning with first and second grooves disposed in the inner surface of the sleeve, respectively, the first and second ends may be configured to resiliently move toward the first position, trapping the first and second protrusions in the first and second grooves, respectively, and the vial within the sleeve.

In one form of the system, the sleeve may be a unitary piece.

In one of the system, the sleeve may include an upper piece and a lower piece, which may be coupled together. A filament may be disposed in a gap between the upper piece and the lower piece and a sticker may be adhered to an outer surface of the upper piece and the lower piece and covering at least a portion of the gap. An end of the filament may be configured to be pulled by a user in order to tear through the sticker and uncouple the upper piece and the lower piece.

In one form of the system, the sleeve wall may include through-holes positioned adjacent to the first and second ends of the compressible element such that by the insertion of a tool, the ends of the compressible element may be deflected to the second position, thereby allowing removal of the compressible element, and thereby releasing the vial from the sleeve.

In one form of the sleeve assembly, the deformable member may be disposed on the cylindrical body such that the deformable member is aligned with the neck of the vial when the vial is fully inserted into the sleeve.

In one form of the sleeve assembly, the deformable member may include an inwardly disposed tip adapted to engage an outer surface of bottom portion of the vial when the vial is partially inserted into the sleeve.

In one form of the sleeve assembly, the tip of the deformable member may be disposed adjacent to the neck of the vial in the first configuration when the vial is fully inserted into the sleeve.

In one form of the sleeve assembly, the tip and finger may form a hook oriented inwardly relative to the longitudinal axis and arranged to engage the shoulder portion of the vial when the vial is fully inserted into the sleeve.

In one form of the sleeve assembly, when the vial is partially inserted into the sleeve, the finger may flex outwardly relative to the longitudinal axis and the deformable member is in the second configuration.

In one form of the sleeve assembly, the tip may flex inwardly and pivot about the knuckle and toward the inner surface of the cylindrical body when the deformable member is in the second configuration.

In one form, the sleeve assembly may include a flange attached to the cylindrical body of the sleeve at the first end of the sleeve. The flange may define an opening at the first end of the sleeve and sized to receive the vial. The flange may be disposed adjacent to the top portion of the vial when the vial is fully inserted into the sleeve.

In one form, the sleeve assembly may include a second deformable member disposed near the bottom end of the sleeve, the second deformable member adapted to engage the bottom portion of the vial.

In one form, sleeve assembly may include a plurality of deformable members arranged near the first end of the body. The plurality of deformable members may be arranged to engage the shoulder of the vial when the vial is fully inserted into the sleeve.

In one form of the method, inserting the vial into the sleeve may include deforming one or more surfaces of the sleeve upon insertion of the vial.

In one form of the method, inserting the vial into the sleeve may include biasing one or more fingers extending upwardly from an upper edge of the opening. Each of the fingers includes a bent portion, and are spaced apart from each other. Prior to insertion of the vial into the sleeve, each of the fingers may be disposed in a first position. In response to the vial being partially inserted into the body, each of the fingers may be biased outwardly to a second position. In response to the vial being fully inserted into the body, each of the fingers may be configured to resiliently return to the first position, contacting a shoulder of the vial and trapping the vial within the body.

In one form of the method, inserting the vial into the sleeve may include biasing outward a plurality of indents formed by a portion of the inner surface pushed inwardly towards a center of the sleeve. Each of the plurality of indents may be spaced apart from the wall along a length of the corresponding indent. Each of the plurality of indents may include a width corresponding to a neck of the vial disposed between a shoulder of the vial and an outwardly protruding top portion of the vial.

In one form, the method may include placing a compressible element around a neck of the vial, wherein the compressible element is configured in a shape of a partial ring and includes a first end and a second end. A flange may extend outwardly from an outer side surface of the compressible element in a horizontal plane. The compressible element may be configured to compress to fit inside an upper portion of the sleeve and to decompress in response to the flange aligning with a groove extending around all or a portion of an inner circumference of the sleeve. The flange may be configured to contact an upper portion of the groove when the flange is aligned with the groove.

In one form of the method, inserting the vial into the sleeve may include biasing a plurality of fingers extending downwardly from the inner surface, wherein the plurality of fingers are spaced apart from each other. Prior to insertion of the vial into the sleeve, each of the plurality of fingers may be disposed in a first position. In response to the vial being partially inserted into the sleeve, each of the plurality of fingers may be biased towards the inner surface in a second position. In response to the vial being fully inserted into the sleeve, each of the plurality of fingers may be configured to resiliently move towards the first position, contacting a shoulder of the vial and trapping the vial within the sleeve.

In one form, the method may include maintaining placement of the vial within the sleeve and under cryogenic conditions until completion of a therapeutic administration of a substance stored within the vial.

In one form of the method, inserting the vial into the sleeve may include inserting the vial via an insertion tool configured to push the sleeve over the vial under cryogenic conditions.

In one form, the method may include storing the vial and sleeve under cryogenic conditions following the step for inserting the vial into the sleeve.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly. The term "horizontal" may be used to refer to a direction parallel to the ground.

BRIEF DESCRIPTION OF THE DRAWINGS

It is believed that the disclosure will be more fully understood from the following description taken in conjunction with the accompanying drawings. Some of the drawings may have been simplified by the omission of selected elements for the purpose of more clearly showing other elements. Such omissions of elements in some drawings are not necessarily indicative of the presence or absence of particular elements in any of the example embodiments, except as may be explicitly delineated in the corresponding written description. Also, none of the drawings is necessarily to scale.

DETAILED DESCRIPTION OF THE DRAWINGS

Figure 1A:
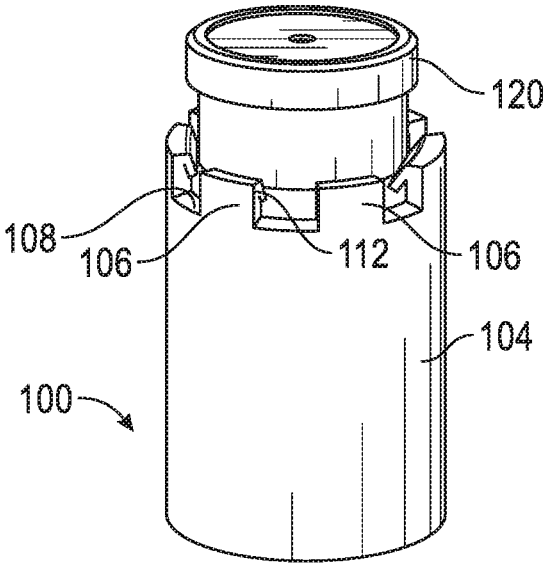
FIG. 1A is a perspective view of a first example vial and sleeve assembly including a first example sleeve coupled with an example vial according to the teachings of the present disclosure.

The present disclosure relates generally to a sleeve for securing a vial, as well as related systems and methods. In some embodiments, the vial may contain contents, such as, for example, a specimen and/or a product. In some embodiments, the vial may include a cryogenic vial that may be maintained under cryogenic conditions, for example a temperature at or below negative 80 degrees C. In some embodiments, the sleeve may be a unitary piece. For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly. The term "horizontal" may be used to refer to a direction parallel to the ground.

The present disclosure relates generally to a sleeve for securing a vial, as well as related systems and methods. A sleeve 100, such as the sleeve in FIG. 1A, may be used as a label for a vial 102. For example, the sleeve 100 may include a particular color, marking, or other indicator of contents of the vial 102. In some embodiments, the color, marking, or other indicator may identify the contents of the vial 102 to an administrator of a blind study but not to a health care professional administering the contents of the vial 102 or a patient receiving the contents of the vial 102. In other embodiments, the sleeve 100 may hide the contents of the vial 102 and/or a previously applied label on the vial 102, such as, for example, an adhesive label.

In some embodiments, the health care professional and/or the patient may not be able to remove the vial 102 from the sleeve 100 without evidence of tampering. Evidence of tampering may include any physical manifestation which indicates that an attempt has been made to remove the vial 102 from sleeve 100 to determine the contents of the vial 102 by viewing a label that has been previously applied to the vial 102. Accordingly, some embodiments of sleeve 100 include one or more features configured to provide evidence of tampering. For example, a sleeve 100 may include one or more surfaces that is visually and/or permanently deformed upon removal of the vial 102 from sleeve 100. Visual or permanent deformation to the sleeve 100 may include breakage, cracking, bending stretch marks, misalignment of parts, scratches, a broken seal, or other similar physical manifestations. In some embodiments, the contents of the vial 102 and/or the previously applied label on the vial 102 may not be viewed without evidence of tampering.

The contents of the vial 102 may include any number of substances, including, for example, a specimen and/or a product. In some embodiments, the vial 102 may include a cryogenic vial 102 that may be maintained under cryogenic conditions, for example a temperature below negative 80 degrees C. In some embodiments, an insertion tool or machine may be used to push the sleeve 100 over the vial 102 at room temperature, at a low temperature, or under cryogenic conditions. In some embodiments, the sleeve 100 may be constructed of plastic, metal, a polymer, and/or another suitable material. In some embodiments, a material of the sleeve 100 may be sustainable at low temperature to allow the sleeve 100 to function and secure the vial 102 at low temperature.

Figure 1B:
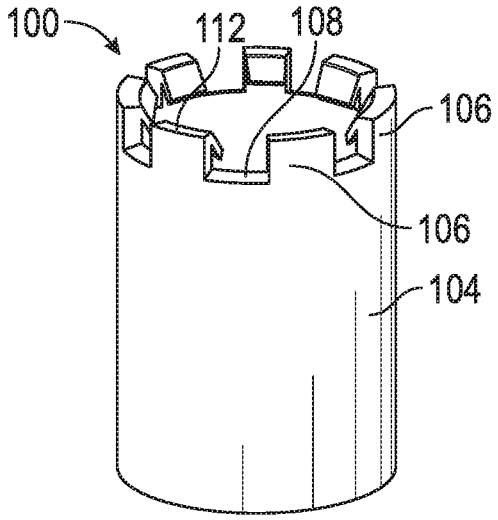
FIG. 1B is a perspective view of the first example sleeve of FIG. 1A.

In FIGS. 1A-1E, the sleeve 100 includes a cylindrical body 104, which may include a cylindrical inner surface configured to receive a lower portion 116 of the vial 102. In some embodiments, the body 104 may include a cylindrical outer surface. In some embodiments, the upper edge 108 of the body 104 may define an opening of the sleeve 100 into which the vial 102 may be inserted. The body 104 includes a longitudinal axis, a first end, and a second end 126. A deformable member 106 is disposed near the first end of the body 104 and is arranged to deform from a first configuration, as illustrated in FIGS. 1A and 1B, to a second configuration shown in FIG. 1C. The deformable member 106 is displaced outwardly relative to the longitudinal axis of the body 104 in the second configuration. In this embodiment, the sleeve 100 includes a plurality of fingers 106 extending upwardly from an upper edge 108 of the first end of the body 104. In another embodiment, the sleeve 100 may include only one extending deformable member 106 or finger.

FIGS. 1A and 1B illustrate the multiple fingers 106 in the first position or configuration, where the fingers 106 are in an unbiased configuration. The sleeve 100 may include any number of fingers 106, for example seven fingers 106, as illustrated in FIGS. 1A and 1B. Each of the plurality of deformable members 106 includes a finger, a tip, and a bent knuckle portion 112 connecting the finger and the tip. The bent knuckle portion 112 includes a bend angle $\alpha$ of, for example, less than 90 degrees. The acute angle $\alpha$ of the bent knuckle portion 112 may facilitate securement of the vial 102 within the sleeve 100. The multiple fingers 106 are spaced apart from each other. Prior to insertion of the vial 102 into the sleeve 100, each of the multiple fingers 106 is disposed or occupies the first position or configuration.

Figure 1C:
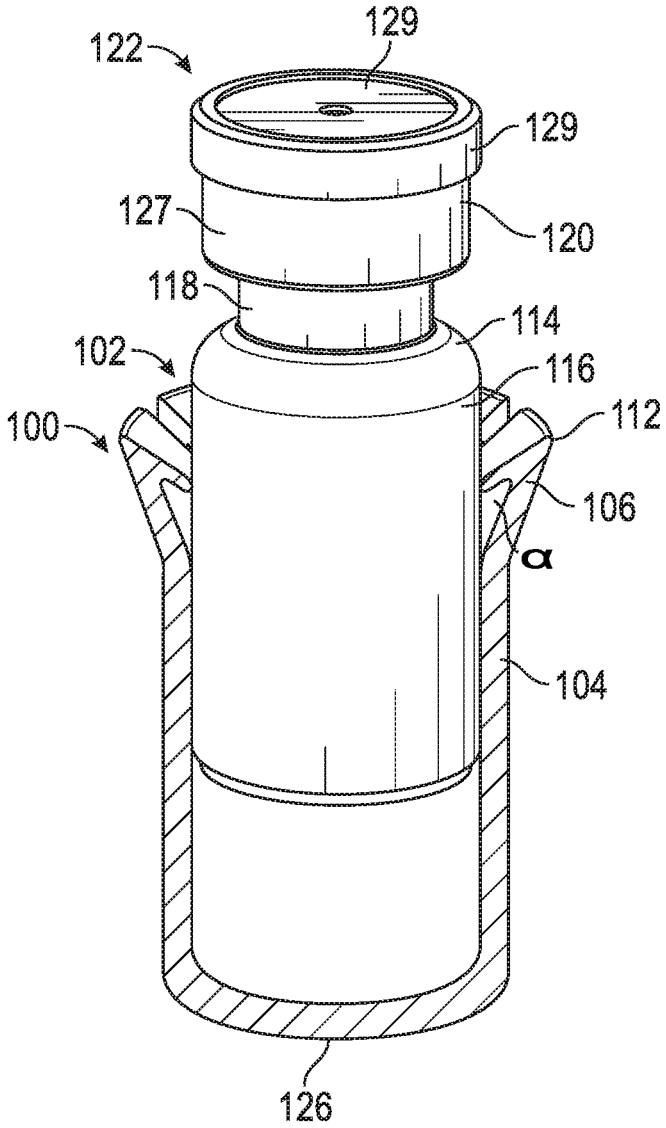
FIG. 1C is a partial cutaway view of the first example vial and sleeve assembly of FIG. 1A, illustrating the vial partially inserted in the first example sleeve.

Referring now to FIG. 1C, in response to the vial 102 being partially inserted into the body 104, each of the multiple fingers 106 may be biased outwardly to the second position or configuration. In response to the vial 102 being fully inserted into the body 104 in FIG. 1D, each of the plurality of fingers 106 is configured to resiliently return toward the first position, contacting a shoulder 114 of the vial 102 and trapping the vial 102 within the body 104 of the sleeve 100.

Figure 1D:
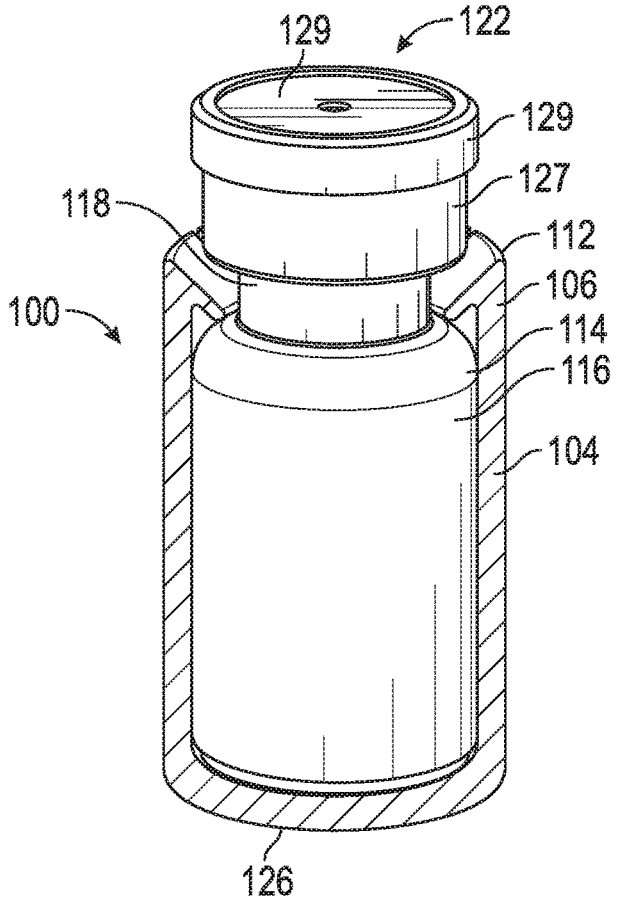
FIG. 1D is a partial cutaway view of the vial and sleeve assembly of FIG. 1A, illustrating the vial fully inserted in the first example sleeve.

The vial 102 may have various shapes. Referring to FIGS. 1C and 1D, the vial 102 includes a lower portion 116, a shoulder 114, a neck 118, and a top portion 120, which may be outwardly protruding relative to the neck 118. The top portion 120 may be sealed with a cap 122, which may include and/or at least partially cover a septum 124. In some embodiments, a bottom 126 of the sleeve 100 may be closed such that the vial 102 may not exit the bottom 126 and a circumference of the lower portion 116 may be constant.

In some embodiments the cap 122 may include a first layer 127, which may be constructed of one or more materials, such as, for example, aluminum. The first layer 127 may be configured to secure the septum 124 to the vial 102 and/or may include an aluminum crimp sleeve. When the cap 122 is in place, the first layer 127 may cover all or a portion of the septum 124. The cap 122 includes a second layer 129, which may be constructed of one or more materials, such as, for example, plastic. The second layer 129 may be fitted over the first layer 127, such that tearing away the second layer 129 from the first layer 127 may remove a central portion of the first layer 127, exposing the septum 124 and allowing insertion of a needle to pierce the septum 124. In some embodiments, the cap 122 may include any number of configurations.

Figure 1E:
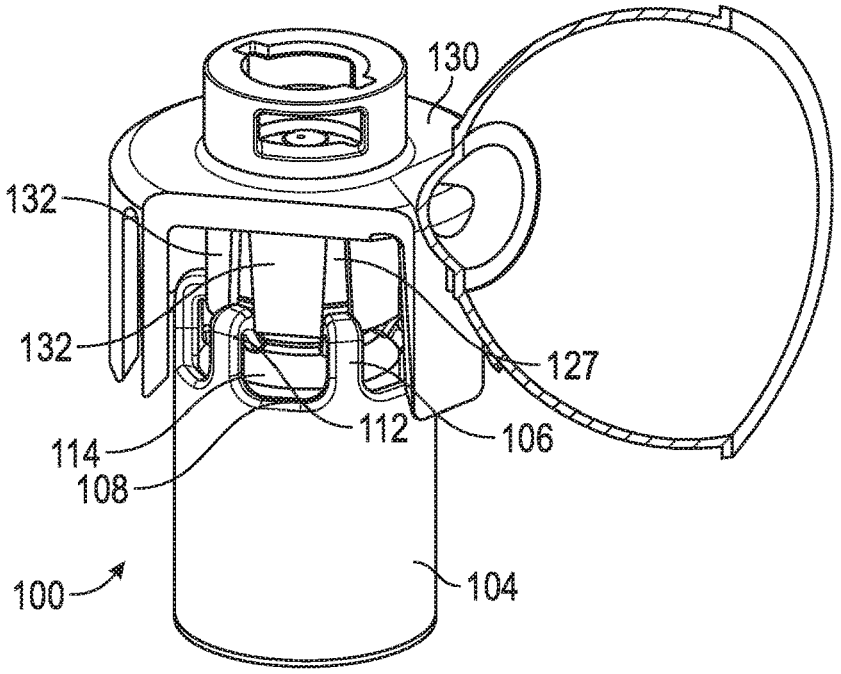
FIG. 1E is a partial cutaway view of an example closed system transfer device coupled with the first example vial and sleeve assembly of FIG. 1A.

Referring now to FIG. 1E, a closed system transfer device ("CSTD") 130 may be coupled with the vial 102. One or more hooks of the CSTD 130 may engage with an outwardly extending bottom surface 206 of a top portion 120 of the vial 102 and/or the cap 122, such as, for example, the first layer 127 of the cap 122. The multiple fingers 106 may share the shoulder 114 and/or neck 118 of the vial 102 with one or more arms 132 of the CSTD 130.

Figure 2A:
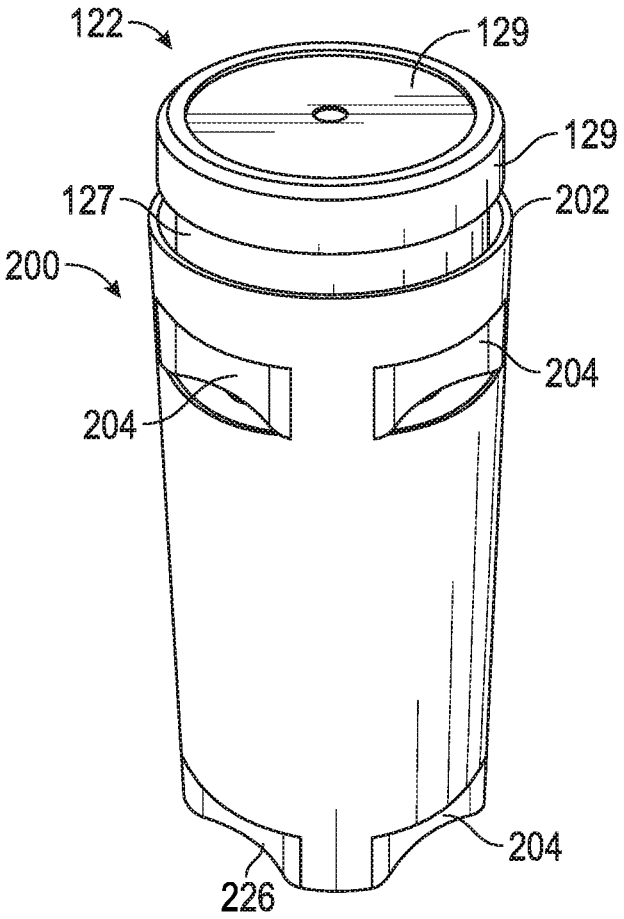
FIG. 2A is a perspective view of a second example vial and sleeve assembly including a second example sleeve coupled with the vial of FIG. 1A according to the teachings of the present disclosure.
Figure 2B:
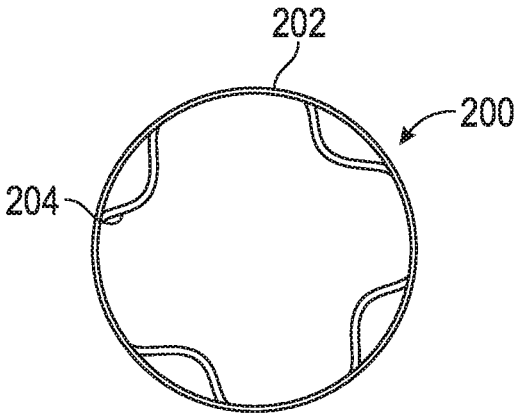
FIG. 2B is a top view of the second example sleeve of FIG. 2A.
Figure 2C:
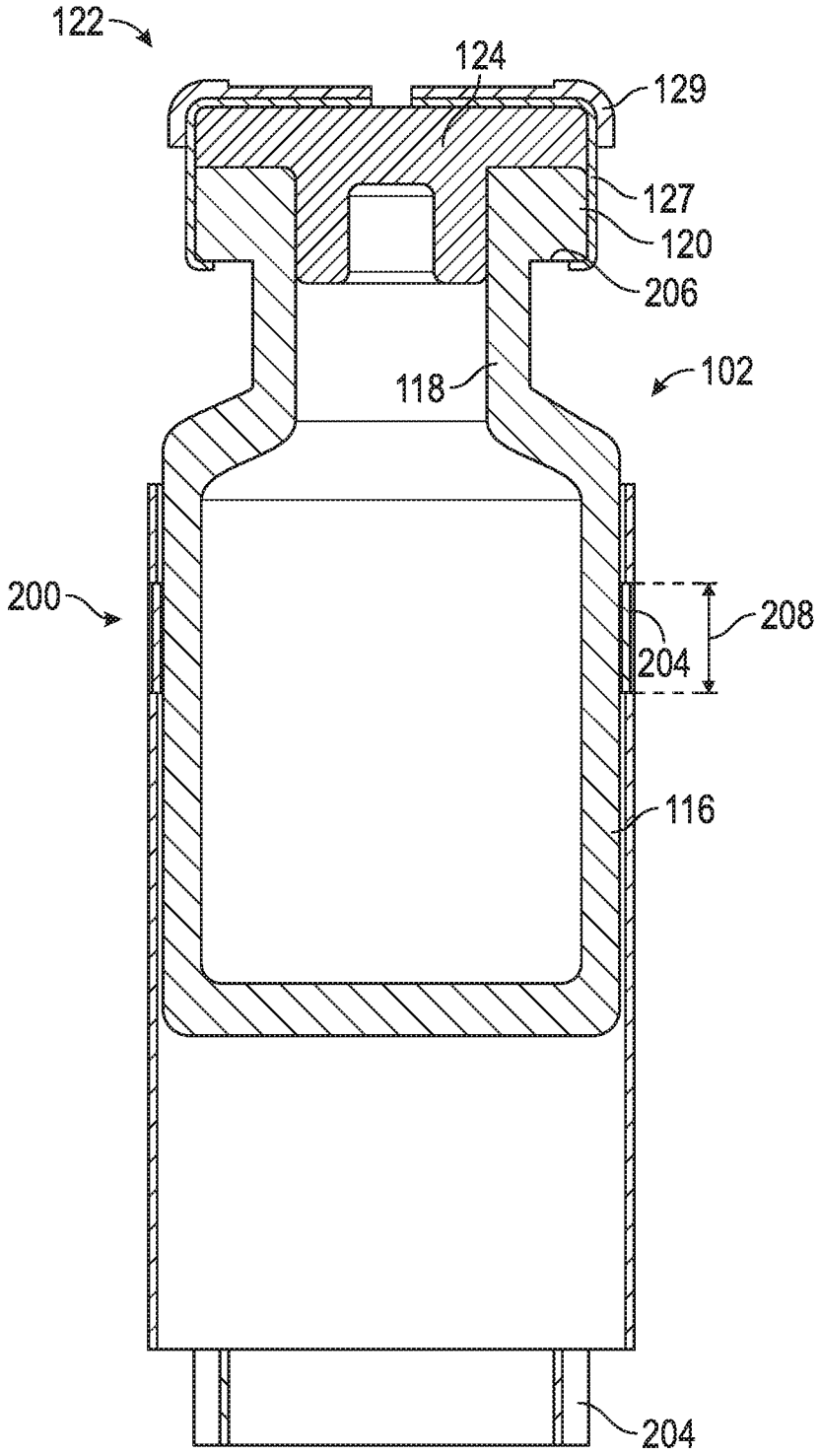
FIG. 2C is a cross-sectional view of the vial and sleeve assembly of FIG. 2A, illustrating the vial fully inserted in the second example sleeve.
Figure 2D:
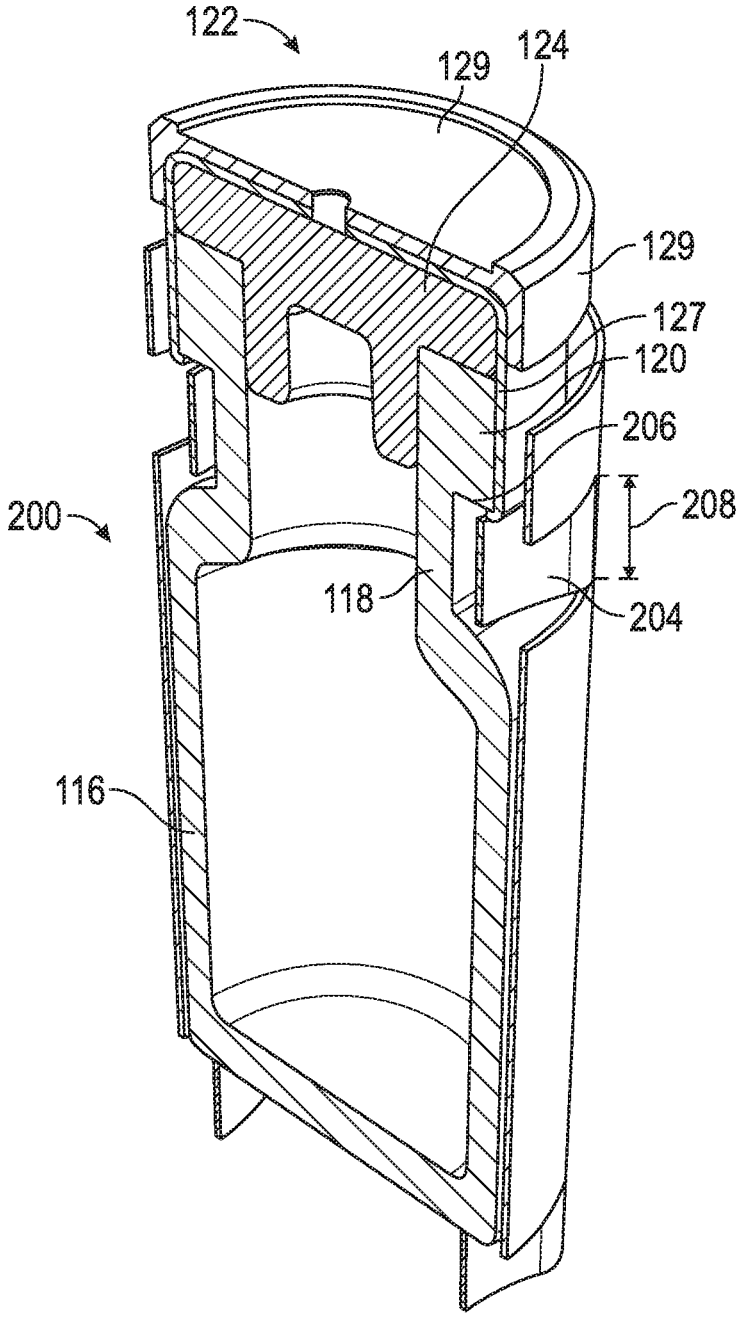
FIG. 2D is a perspective view of the cross-sectional view of the second example vial and sleeve assembly of FIG. 2C.

A second example vial and sleeve assembly is illustrated in FIGS. 2A-2C and includes a sleeve 200 that may be or correspond to the sleeve 100. The sleeve 200 includes inner and outer surfaces that form a wall 202. The sleeve 200 includes a plurality of deformable members 204 or multiple indents 204 that are disposed in the wall 202. Each of the multiple indents 204 is formed by a portion of the wall 202 pushed inwardly towards a longitudinal axis or center of the sleeve 200. Each of the multiple indents 204 is spaced apart from the wall 202 along a length of the corresponding indent 204. In further detail, an upper edge and a lower edge of each of the multiple indents 204 is spaced apart from the wall 202 along a length of each of the upper edge and the lower edge, as illustrated, for example, in FIG. 2B. FIG. 2C illustrates the vial 102 partially inserted into the sleeve 200, the bottom portion 116 of the vial pushing the indents 204 outwardly and away from the longitudinal axis of the sleeve 200 to occupy the second configuration.

The multiple indents 204 are configured to align with the neck 118 of the vial 102, contacting the shoulder 114 and/or a bottom surface 206 of the top portion 120 of the vial 102 and trapping the vial 102 within the sleeve 200, as illustrated, for example, in FIG. 2C. In FIG. 2C, the vial is fully inserted into the sleeve 200 and the multiple indents proximate to the top portion of the sleeve 200 are in the first configuration. Each of the multiple indents 204 includes a width 208 corresponding to a width of the neck 118 of the vial 102, which is disposed between the shoulder 114 and the top portion 120 of the vial 102.

In a preferred embodiment, the vial 102 may be inserted into the sleeve 200 prior to formation of the multiple indents 204. Once the vial 102 is fully inserted into the sleeve 200, as illustrated in FIG. 2C, the multiple indents 204 may be deformed inwardly (or return to the first configuration) to engage the neck 118 and secure the vial 102 within the sleeve 200. For example, the multiple indents 204 may be laser-cut to deform inwardly.

One or more indents 204 may be disposed at least proximate a bottom portion 116 of the vial 102, which may facilitate indexing of the sleeve 200 to correctly orient a crimping tool. The indents 204 disposed at the bottom or lower portion 116 of the sleeve 200 may support the vial 102 and keep the vial 102 from falling through the open end 226 of the sleeve 200.

Referring now to FIGS. 3A-3D, a system for securing the vial 102 include a vial and sleeve assembly including a sleeve 300 and a compressible element 302. The sleeve 300 may include or correspond to the sleeve 100 of FIG. 1 and/or the sleeve 200 of FIG. 2. The compressible element 302 is configured to be secured or placed around the neck 118 of the vial 102. In some embodiments, the compressible element 302 may be configured in a shape of a ring or in a shape of a partial ring. The compressible element 302 includes a first end 304 and a second end 306. In the illustrated embodiment, the third vial and sleeve assembly secures the vial 102 to the sleeve 300 with the help of the compressible element 302. In other embodiments, the sleeve 300 may secure to the vial 102 without requiring the compressible element 302.

The sleeve 300 may include one or more apertures 308 to allow a health care professional to view the contents in the vial 102. In some embodiments, the sleeve 300 may be configured such that the contents of the vial 102 may be viewed from a top and/or a bottom of the vial 102.

The compressible element 302 includes a flange 310 that extends outwardly from an outer side surface of the compressible element 302 in a horizontal plane. The compressible element 302 is configured to compress to fit inside an upper portion of the sleeve 300, as illustrated, for example, in FIG. 3B, and to decompress in response to the flange 310 aligning with a groove 312 disposed in an inner surface of the sleeve 300, as illustrated, for example, in FIG. 3D. The groove 312 extends around at least a portion of an inner circumference of the sleeve 300. The flange 310 is configured to contact an upper portion of the groove 312 when the flange 310 is aligned with the groove 312, which may prevent the compressible element 302 and the vial 102 from being removed upwardly through an opening of the sleeve 300.

An upper surface 314 of the compressible element 302 is disposed in another horizontal plane. The compressible element 302 includes a lower surface 316 opposite the upper surface 314 and disposed at an angle with respect to the upper surface 314. The lower surface 316 may be configured to contact the shoulder 114 of the vial 102 when the flange 310 is aligned with the groove 312, and the upper surface 314 may be configured to contact the bottom surface 206 of the top portion 120 of the vial 102 when the flange 310 is aligned with the groove 312.

An outer surface of the sleeve 300 includes an outer flange 318 extending around at least a portion of an outer circumference of the sleeve 300. The outer flange 318 extends to a first end of the sleeve 300 and includes an aperture 319 (illustrated in FIGS. 3A-3C) to facilitate removal of the cap 122 of the vial 102.

Figure 3A:
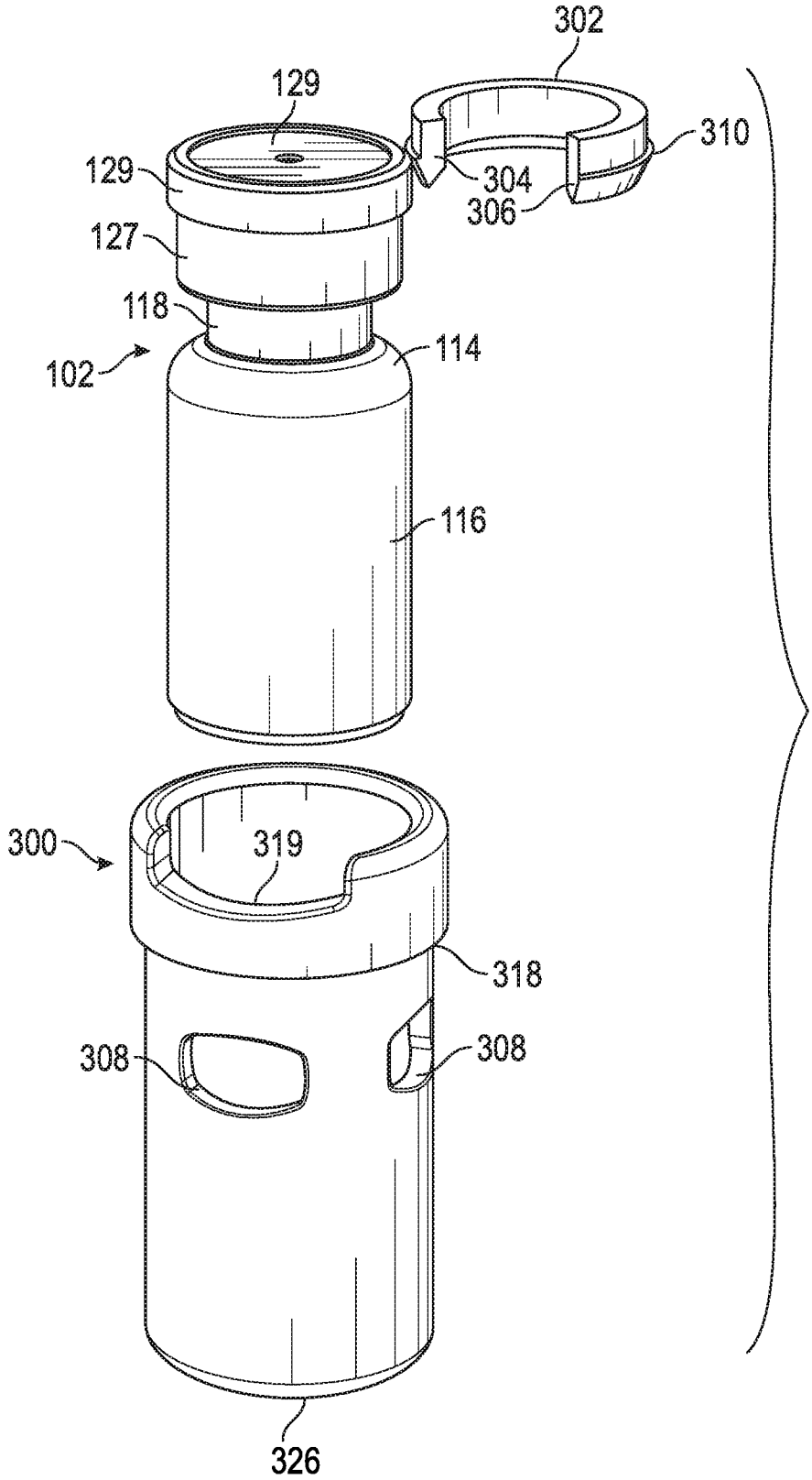
FIG. 3A is an exploded view of a third example vial and sleeve assembly system including a third example sleeve, a first example compressible element, and the vial of FIG. 1A according to the teachings of the present disclosure.
Figure 3C:
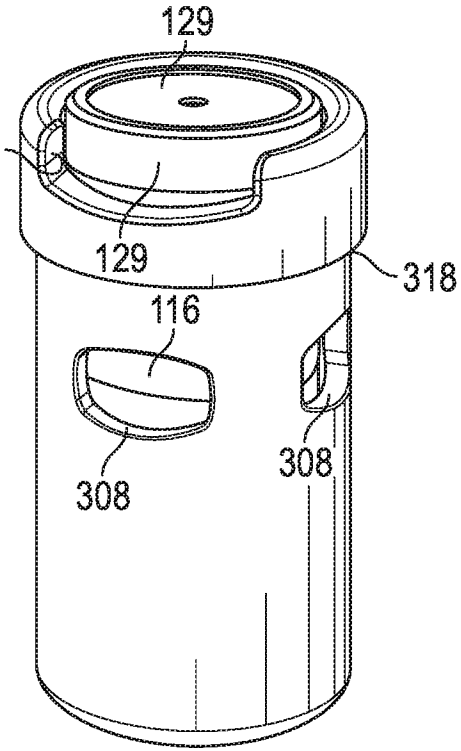
FIG. 3C is a perspective view of the third example vial and sleeve assembly of FIG. 3A, illustrating the vial fully inserted in the third example sleeve and the compressible element around a neck of the vial.
Figure 3B:
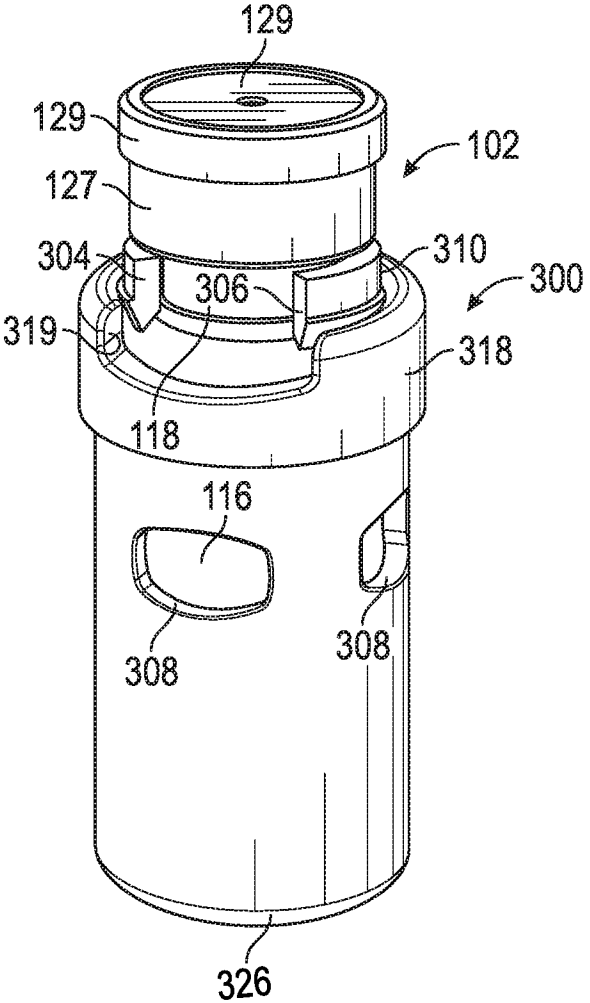
FIG. 3B is a perspective view of the third example vial and sleeve assembly of FIG. 3A, illustrating the vial partially inserted in the third example sleeve.
Figure 3D:
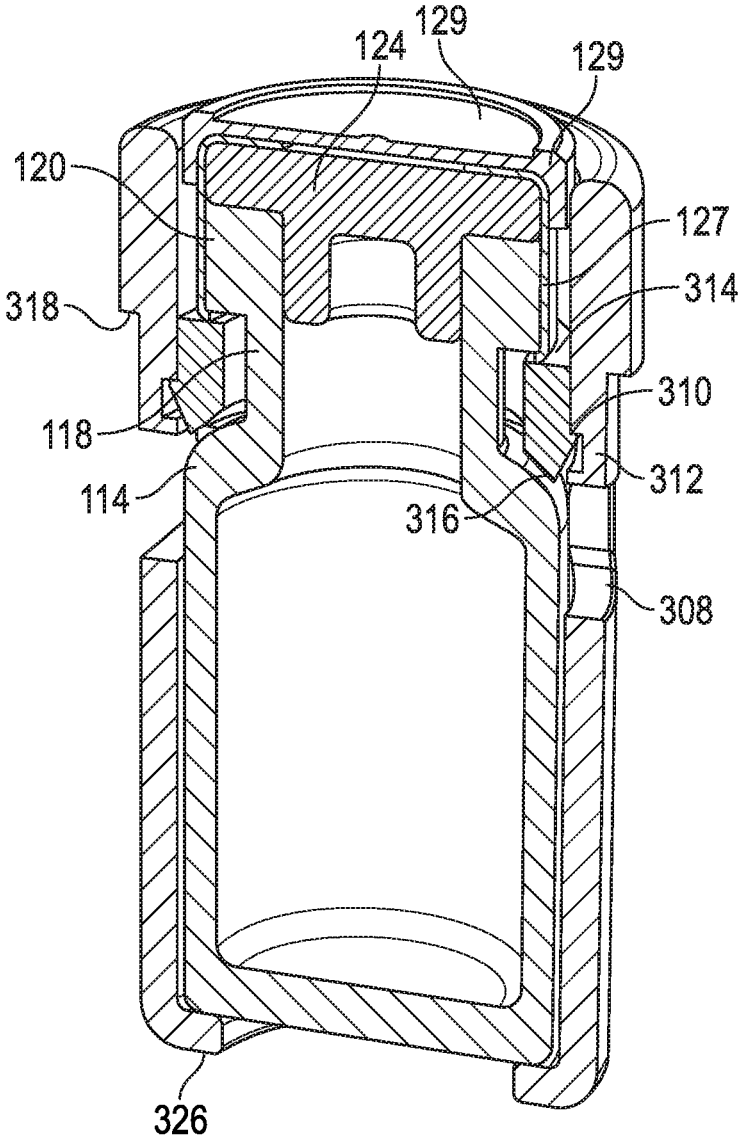
FIG. 3D is a cross-sectional view of the third example vial and sleeve assembly of FIG. 3A.
Figure 3E:
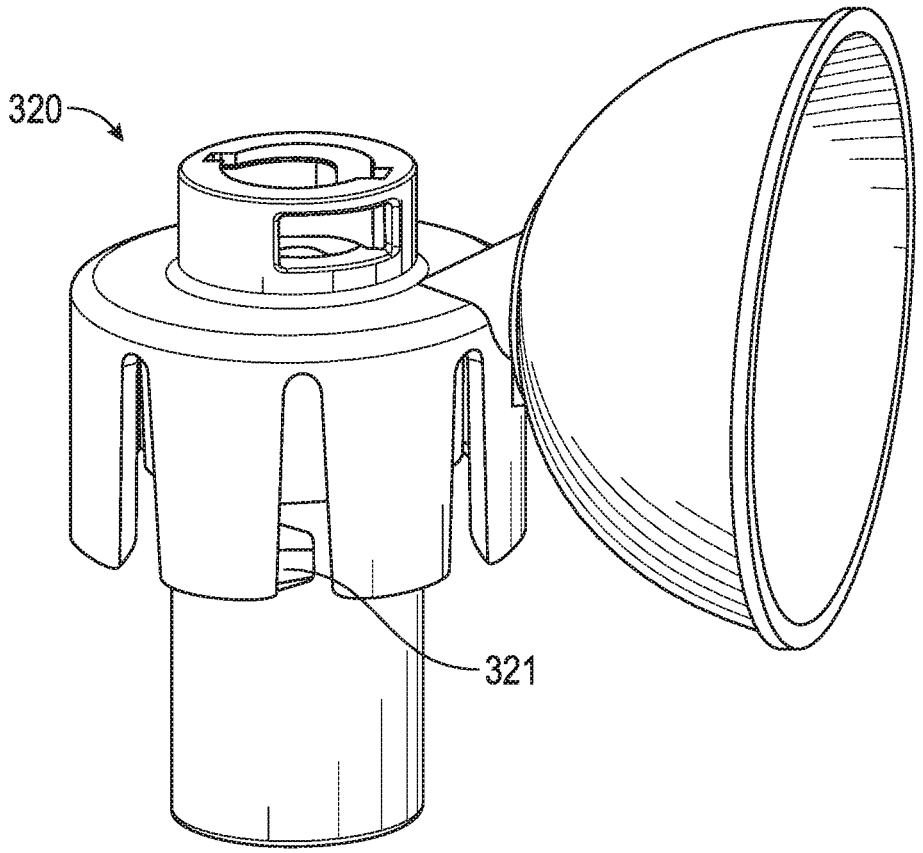
FIG. 3E is a perspective view of an example closed system transfer device coupled with the third example vial and sleeve assembly of FIG. 3A.
Figure 3F:
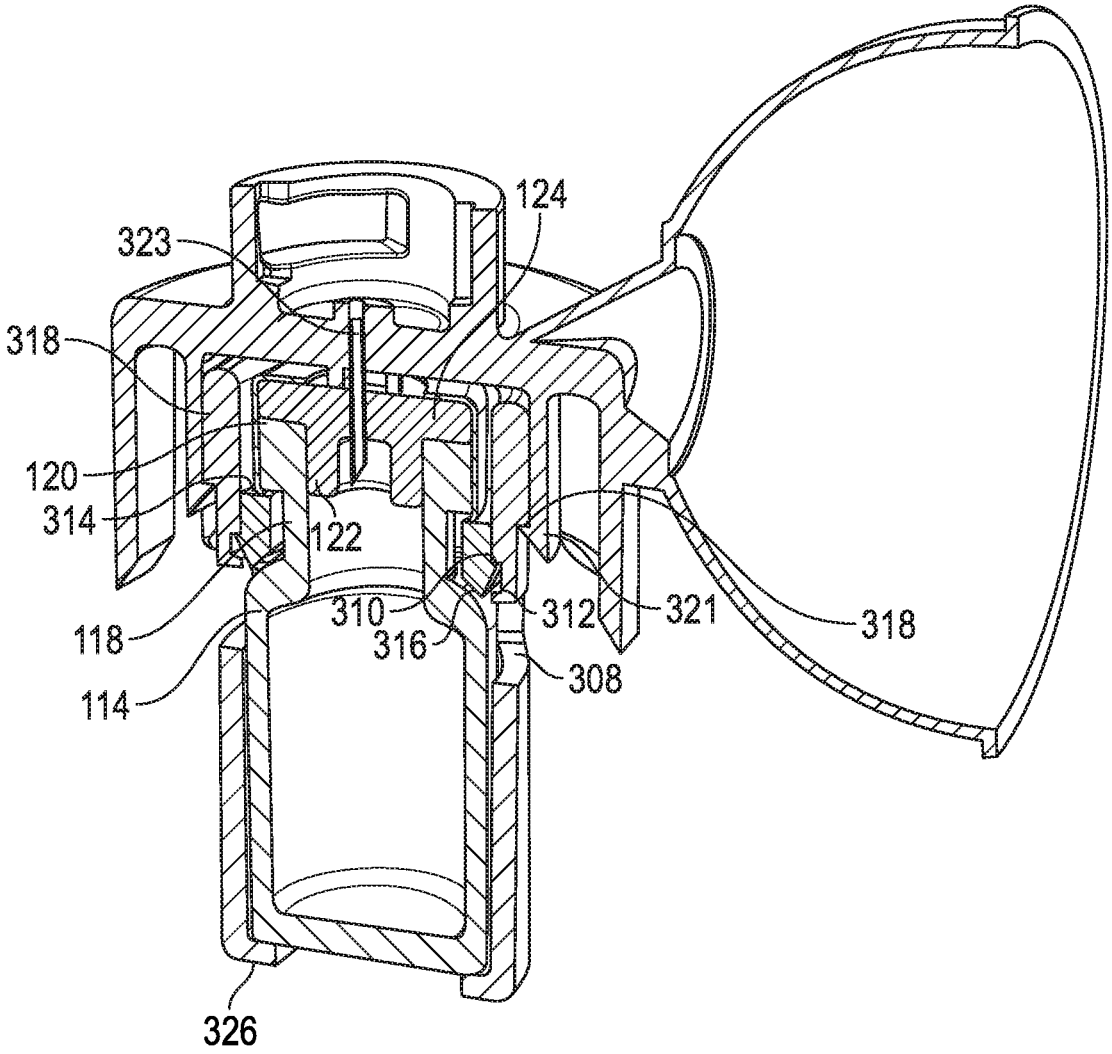
FIG. 3F is a cross-sectional view of the closed system transfer device coupled with the third example vial and sleeve assembly of FIG. 3E.

Referring now to FIGS. 3E and 3F, the outer flange 318 is configured to engage with a device or adapter, such as, for example, a closed system transfer device ("CSTD") 320. The CSTD 320 includes a plurality of arms or hooks 321, which couples to a bottom surface of the outer flange 318, as illustrated, for example, in FIG. 3F. Coupling may include a friction or interference fit. The compressible element 302 attached to the neck 118 of the vial 102 may not permit attachment of the CSTD 320 to the vial 102. So configured, the outer flange 310 provides an alternate coupling location for coupling with the CSTD 320. A needle 323 of the CSTD 320 may pierce the septum 124 to allow access to the contents of the vial 102, as illustrated, for example, in FIG. 3F. In some embodiments, a size of the outer flange 318 may be one standard size larger than a size of the cap 122. Thus, in some embodiments, a size of the CSTD 320 may correspond to the size of the outer flange 318. For example, the CSTD 320 may be sized and configured to be used in a particular system with a 20 mm cap 122 and a 15 mm diameter cap 122.

Figure 3G:
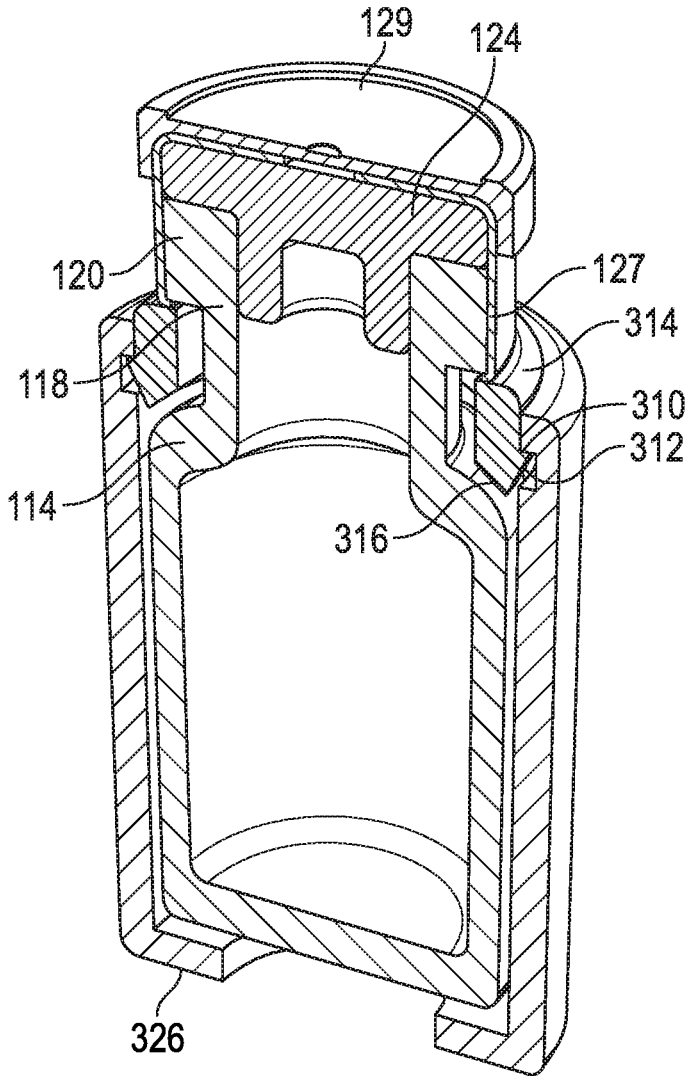
FIG. 3G is a cross-sectional view of the third example vial and sleeve assembly of FIG. 3A.
Figure 3H:
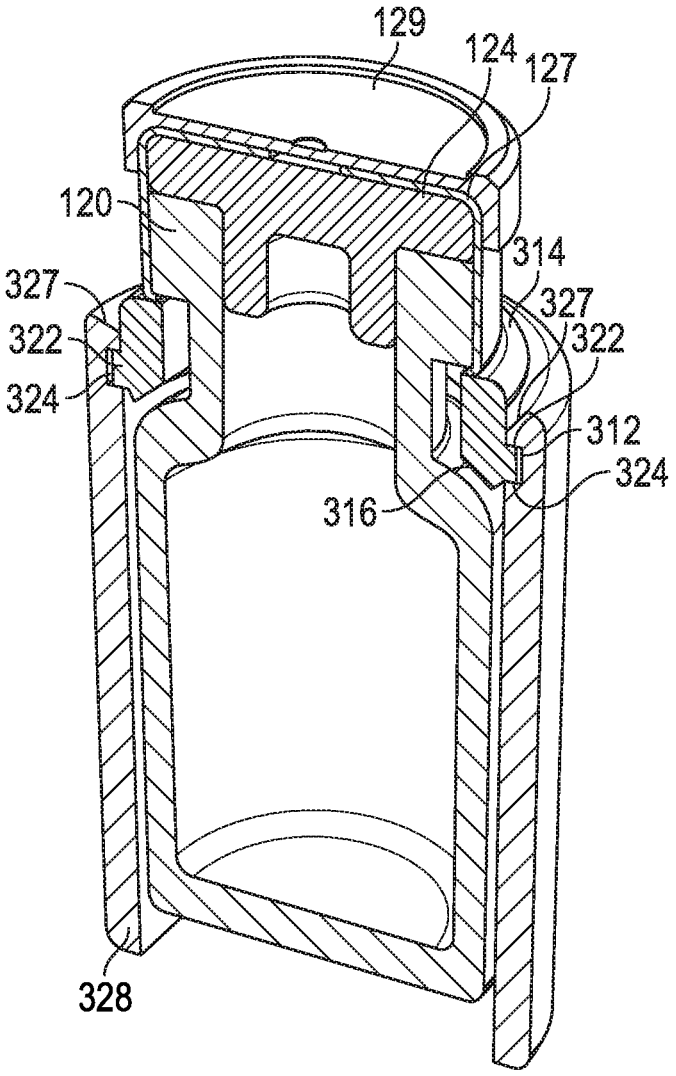
FIG. 3H is a cross-sectional view of a different embodiment of the third example vial and sleeve assembly of FIG. 3A.

As illustrated in FIG. 3A-3D, in some embodiments, the sleeve 300 may extend along all or almost all of a length of the vial 102. In FIG. 3G, the sleeve 300 extends along a portion of the length of the vial 102. A bottom end 326 of the sleeve 300 may be partially closed to engage the vial 102 when the vial 102 is fully inserted into the sleeve 300. In a different sleeve 300 illustrated in FIG. 3H, a bottom 328 of the sleeve 300 may be open. Additionally, the sleeve in FIG. 3H includes a variation of the compressible element 302 in the previous figures, and includes a first flange 322 and a second flange 324 which extend parallel to each other, each in a horizontal plane. The first and second flanges 322, 324 may prevent the compressible element 302 and the vial 102 from moving upward and downward, respectively. In some embodiments, the sleeve 300 may include a tapered entry 327, which may facilitate compression of the ring during insertion.

Referring now to a fourth example vial and sleeve assembly in FIGS. 4A-4D, a sleeve 400 includes an enlarged outer flange 402 extending from a top portion of the sleeve 400. The sleeve 400 may include or correspond to one or more of the following: the sleeve 100 of FIG. 1, the sleeve 200 of FIG. 2, and the sleeve 300 of FIG. 3. As an example, one or more apertures 404 may include or correspond to the apertures 308 of FIG. 3 and/or the outer flange 402 may include or correspond to the outer flange 316 of FIG. 3.

Figure 4A:
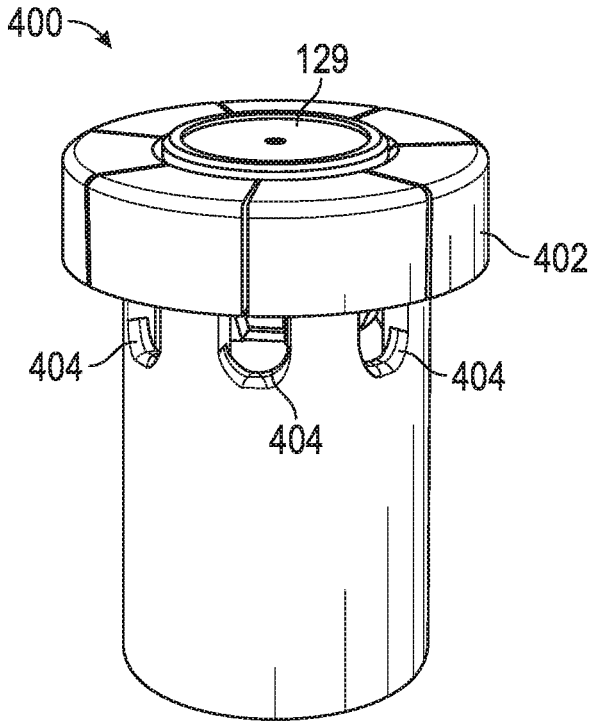
FIG. 4A is a perspective view of a fourth example vial and sleeve assembly including a fourth example sleeve coupled with the vial of FIG. 1A according to the teachings of the present disclosure.
Figure 4B:
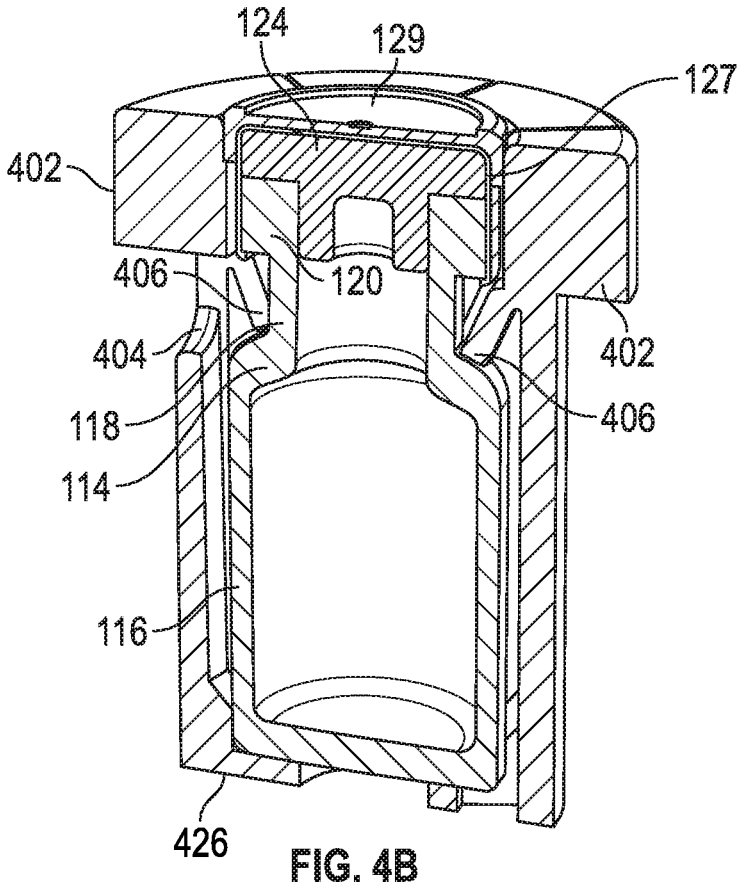
FIG. 4B is a cross-sectional view of the vial and sleeve assembly of FIG. 4A, illustrating the vial fully inserted in the fourth example sleeve.
Figure 4C:
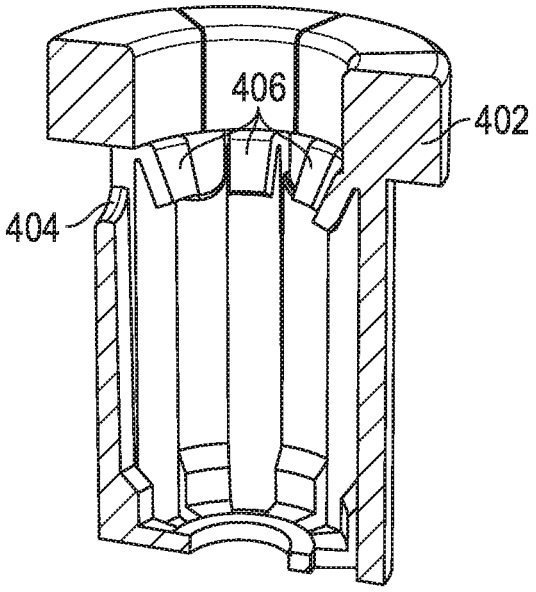
FIG. 4C is a cross-sectional view of the fourth example sleeve of FIG. 4A.
Figure 4D:
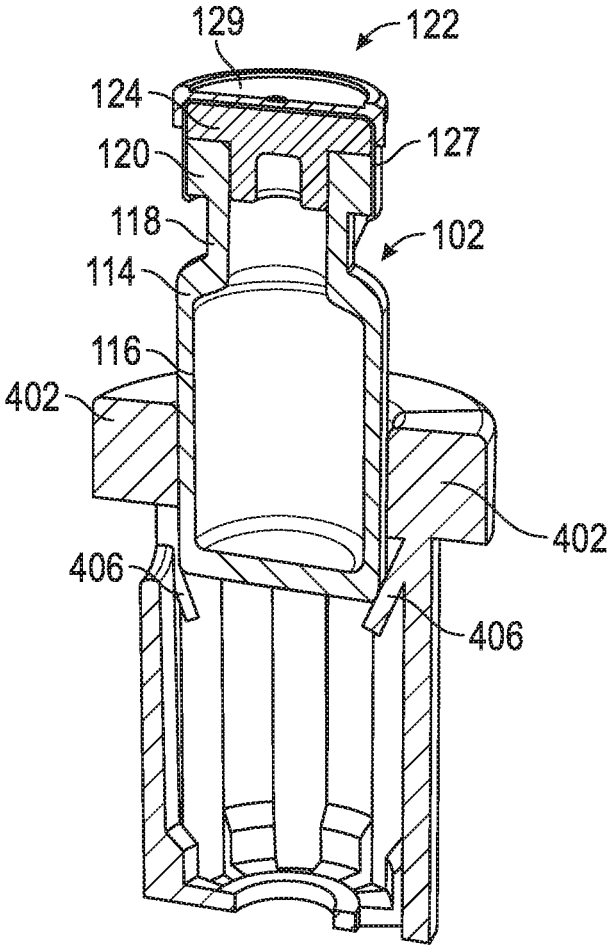
FIG. 4D is a cross-sectional view of the fourth example vial and sleeve assembly of FIG. 4A, illustrating the vial partially inserted in the fourth example sleeve.

As shown in FIGS. 4B and 4C, the sleeve 400 includes a plurality of deformable members 406 or fingers 406 spaced apart and extending downwardly from the inner surface of the sleeve 400 near the top portion of the sleeve 400. In the illustrated example, the second end 426 of the sleeve 400 is partially open, forming a ledge configured to hold the vial 102 in place. Prior to insertion of the vial 102 into the sleeve 400, each of the multiple fingers 406 is disposed in a first position or configuration, illustrated, for example, in FIG. 4C. In response to the vial 102 being partially inserted into the sleeve 400, each of the multiple fingers 406 is biased outwardly relative to the longitudinal axis and toward the inner surface of the sleeve 400, as shown in FIG. 4D. When the deformable members 406 deform from the first configuration to a second position or configuration, the tip of each finger 406 flexes outwardly relative to the longitudinal axis of the sleeve 400 and pivots at the bent knuckle portion of the deformable member 406 (i.e. where the flange 402 attaches to the top portion of the sleeve 400). As illustrated, for example, in FIG. 4B, in response to the vial 102 being fully inserted into the sleeve 400, the tip of each finger 406 pivots about the bent knuckle portion to resiliently move back toward the first configuration and engage the shoulder 114 of the vial 102, thereby and trapping the vial 102 within the sleeve 400.

Figure 4E:
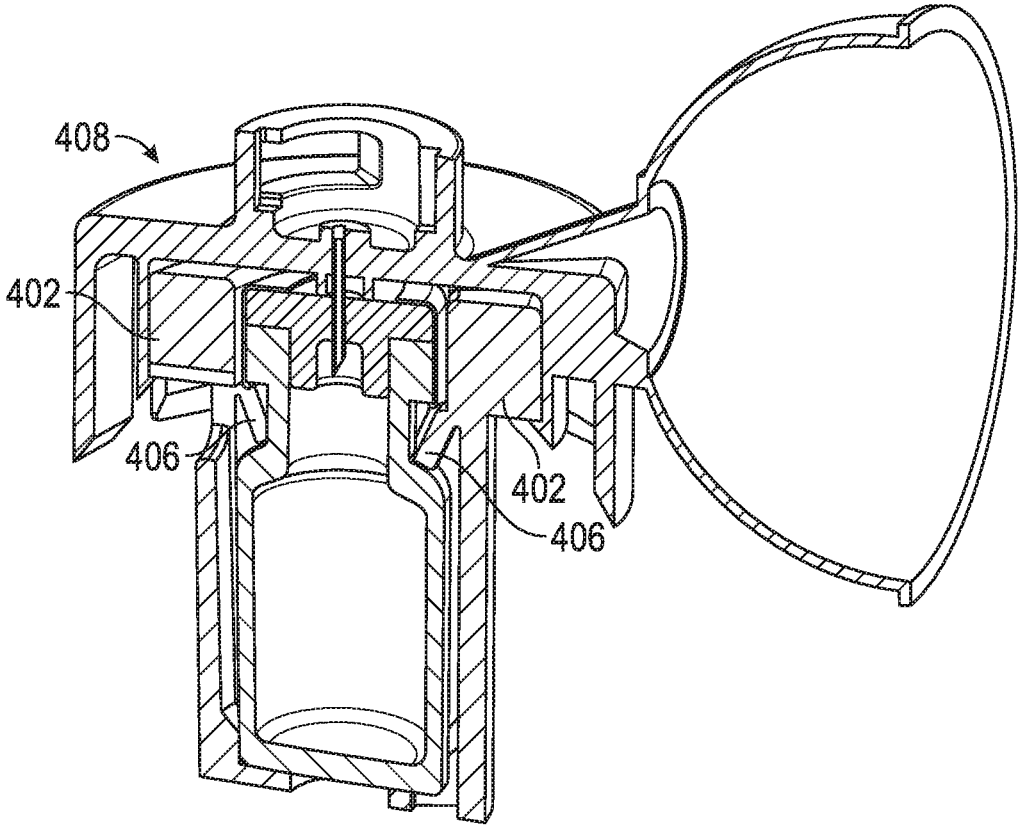
FIG. 4E is a cross-sectional view of an example closed system transfer device coupled to the fourth example vial and sleeve assembly of FIG. 4A.

In FIG. 4E, the outer flange 402 is configured to engage with a device or adapter, such as, for example, a CSTD 408, which may include or correspond to the CSTD 320 in some embodiments. A size of the outer flange 402 may be selected based on a size of a corresponding receiving portion for the outer flange 402. The receiving portion may be disposed in a lower surface of the CSTD 320.

Referring now to a fifth vial and sleeve assembly in FIGS. 5A-5F, a system may include a sleeve 500 and a compressible element 502. The sleeve 500 may include or correspond to one or more of the following: the sleeve 100 of FIG. 1, the sleeve 200 of FIG. 2, the sleeve 300 of FIG. 3, and the sleeve 400 of FIG. 4. In some embodiments, the compressible element 502 may include or correspond to the compressible element 302, and the sleeve 500 may secure to the vial 102 with or without the compressible element 502.

The compressible element 502 includes a first end 504 having a first protrusion 506, and a second end 508 having a second protrusion 510. A wall 512 of the sleeve 500 is defined by the inner and outer surfaces of the sleeve 500 and includes a slot 516 sized to receive the compressible element 502. The slot 516 is aligned with the neck 118 of the vial 102 such that the compressible element 502 is secured around the neck 118 of the vial through the slot 516, as illustrated in FIG. 5C. The vial 102 may be easily inserted into the sleeve 500 without exerting a large downward force, and secured via insertion of the compressible member 502 fully in the slot 516. The vial 102 and the compressible element 502 may be partially and/or fully inserted into the sleeve 500 by exerting a downward force on the vial 102 and compressible element 502. The compressible element 502 may be partially and/or fully inserted into the sleeve 500 by exerting a lateral force on the compressible element 502 when the compressible element 502 is inserted into the slot 516 disposed in the sleeve 500.

Figure 5A:
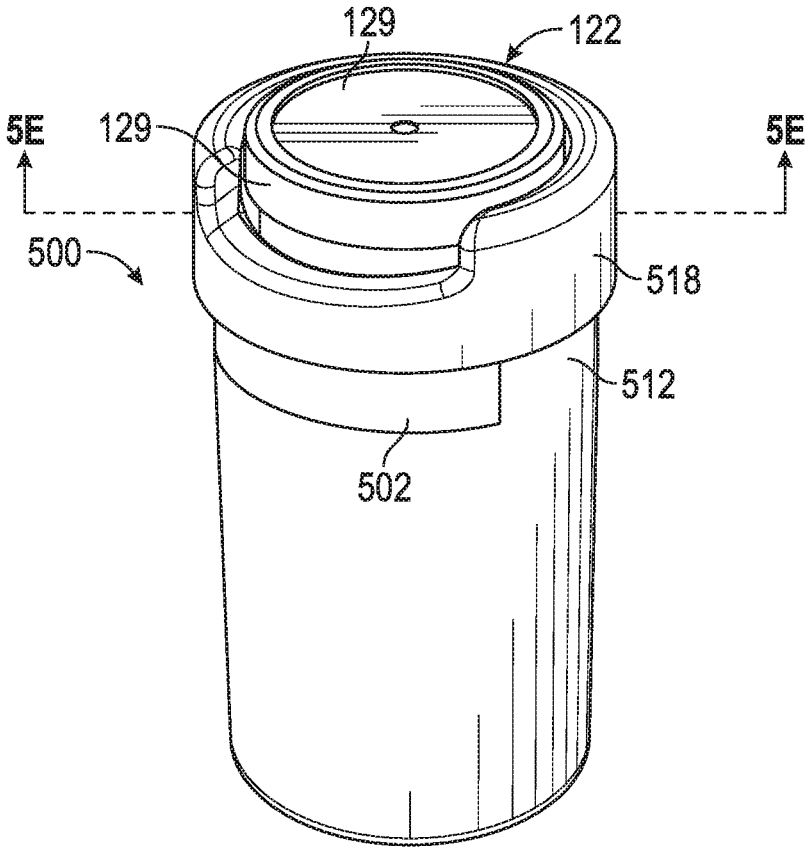
FIG. 5A is a perspective view of a fifth example vial and sleeve assembly including a fifth example sleeve, a second example compressible element, and the vial of FIG. 1A according to the teachings of the present disclosure.
Figure 5B:
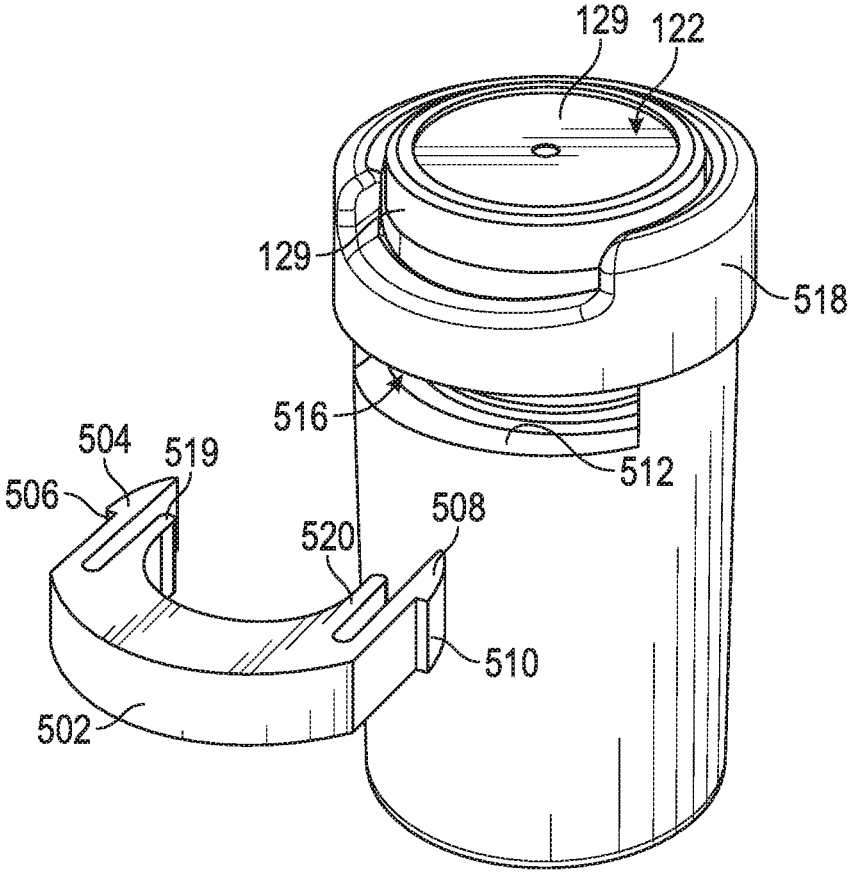
FIG. 5B is a perspective view of the fifth example vial and sleeve assembly of FIG. 5A, illustrating the second example compressible element removed from the fifth example sleeve.
Figure 5C:
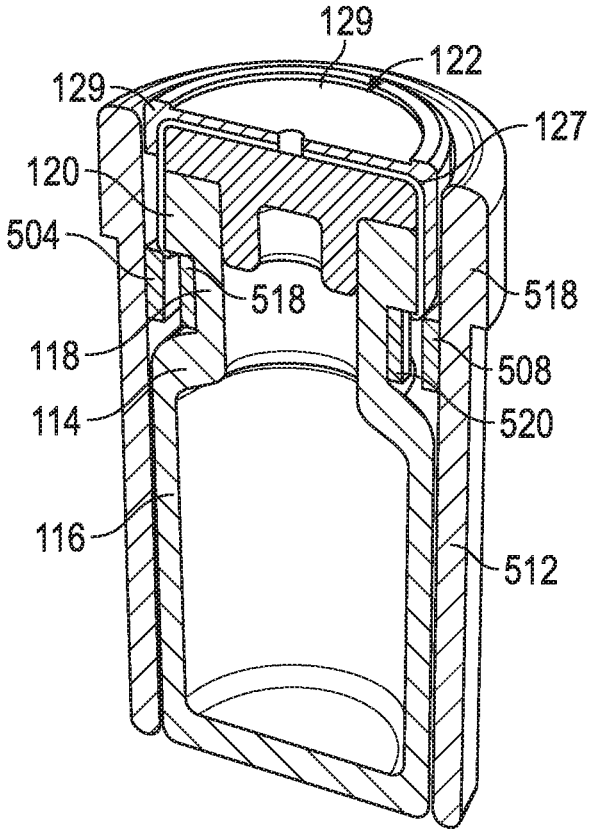
FIG. 5C is a cross-sectional view of the fifth example vial and sleeve assembly of FIG. 5A.

Prior to insertion of the compressible element 502 into the slot 516, the first and second ends 504, 508 may be disposed in a first position or configuration, illustrated, for example, in FIG. 5B. In response to the compressible element 502 being partially inserted into the slot 516, the inner surface of the sleeve 500 is configured to press the first and second ends 504, 508 inwardly into a second position or configuration, as illustrated, for example, in FIG. 5F. In response to the compressible element 502 being fully inserted into the slot 516 and the first and second protrusions 506, 510 aligning with first and second grooves 515, 517 disposed in the inner surface of the sleeve 500, respectively, the first and second ends 504, 508 are configured to resiliently move toward the first position, trapping the first and second protrusions 506, 510 in the first and second grooves 515, 517, respectively, and the vial 102 within the sleeve 500. The first and second grooves 515, 517 are illustrated, for example, in FIG. 5E, which is a cross-sectional view along line 1-1 of FIG. 5A. The compressible element 502 includes first and second extensions 519, 520 spaced apart from the first and second ends 504, 508 to support and facilitate the first and second ends 504, 508 when deforming from the first configuration to the second configuration.

Figure 5D:
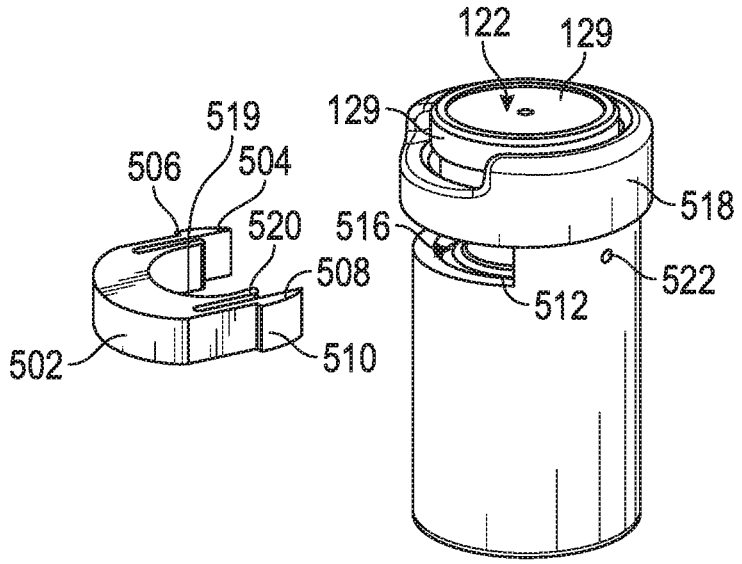
FIG. 5D is a perspective view of the second example compressible element removed from the fifth example sleeve and vial of FIG. 5B.
Figure 5E:
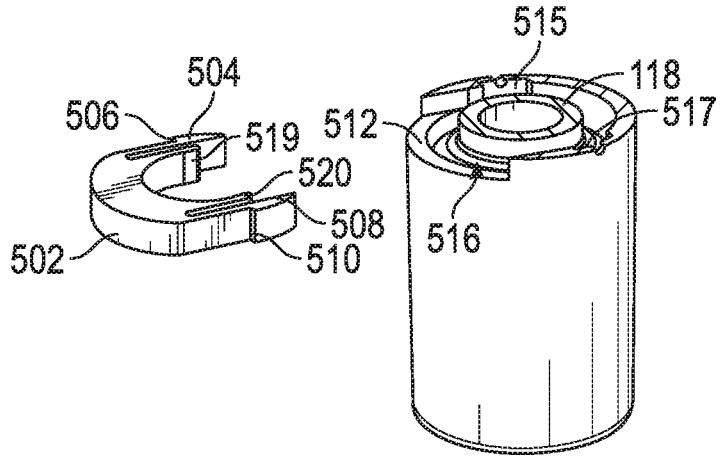
FIG. 5E is a partial perspective view of the second example compressible element removed from a partially illustrated fifth example sleeve and vial of FIG. 5D.
Figure 5F:
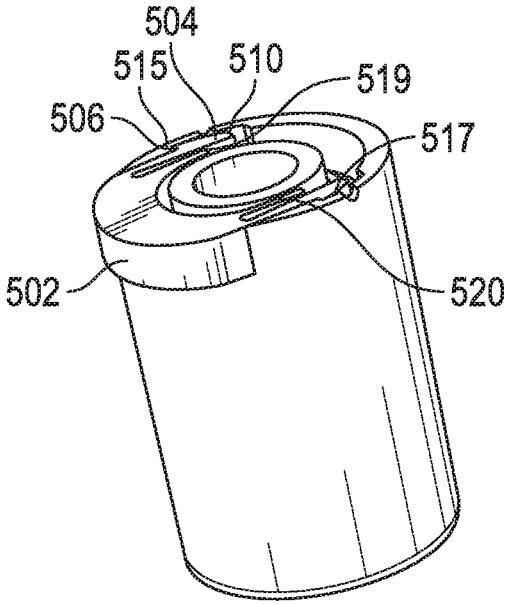
FIG. 5F is a perspective view of the second example compressible element partially inserted within the partial fifth example vial and sleeve assembly of FIG. 5E.

The sleeve 500 includes an outer flange 518 for coupling with a CSTD, such as, for example, CSTD 320 and/or CSTD 408. A bottom of the sleeve 500 is open, as illustrated, for example, in FIG. 5C, and in another embodiment, the bottom of the sleeve 500 may be closed. As best shown in FIGS. 5D and 5E, the first and second protrusions 506, 510 are configured to fit within the first and second grooves 515, 517 to prevent the vial 102 from moving upwards or downwards with respect to the sleeve 500. In the embodiment illustrated in FIGS. 5D and 5E, the sleeve 500 includes one or more pin holes 522 which is configured to align with the first end 504 and/or the second end 508 of the compressible element 502. The pin holes 522 may allow insertion of a pin or similar object to press the first end 504 and/or the second end 508 inwardly and remove the compressible element 502 from the sleeve 500, allowing the vial 102 to be removed from the sleeve 500 for any number of purposes, such as, for example, direct conductive thermal contact of an exterior surface of the vial 102 with a thawing tool.

In some embodiments, a particular sleeve may be a unitary piece. Referring now to FIGS. 6A-6F, in some embodiments, a sleeve 600 may include an upper piece 602 and a lower piece 604, which may be coupled together. In some embodiments, the sleeve 600 may include or correspond to one or more of the following: the sleeve 100 of FIG. 1, the sleeve 200 of FIG. 2, the sleeve 300 of FIG. 3, the sleeve 400 of FIG. 4, and the sleeve 500 of FIG. 5. In some embodiments, the upper piece 602 and the lower piece 604 may be coupled together via a first means and/or an adhesive sticker 606. The first means may include an interference fit, friction fit, threading, or another means of coupling. In some embodiments, the upper piece 602 and the lower piece 604 may include one or more projections and/or corresponding receiving portions that may interact with each other in order to couple the upper piece 602 and the lower piece 604. In some embodiments, the system may include a filament 608, which may be disposed in a gap 610 between the upper piece 602 and the lower piece 604. In some embodiments, the gap 610 may extend around all or a portion of an outer circumference of the upper piece 602, the lower piece 604, and/or between the upper and lower pieces 602, 604.

In some embodiments, the system may include the sticker 606 adhered to an outer surface of the upper piece 602 and the lower piece 604 and covering at least a portion of the gap 610. In some embodiments, the sticker 606 may extend around all or a portion of an outer circumference of the sleeve 600. In some embodiments, an end of the filament 608 is configured to be pulled by a user in order to tear through the sticker 606 and uncouple the upper piece 602 and the lower piece 604. In some embodiments, the end of the filament 608 may be disposed within a tab 612, which may aid in pulling the filament 608.

Figure 6A:
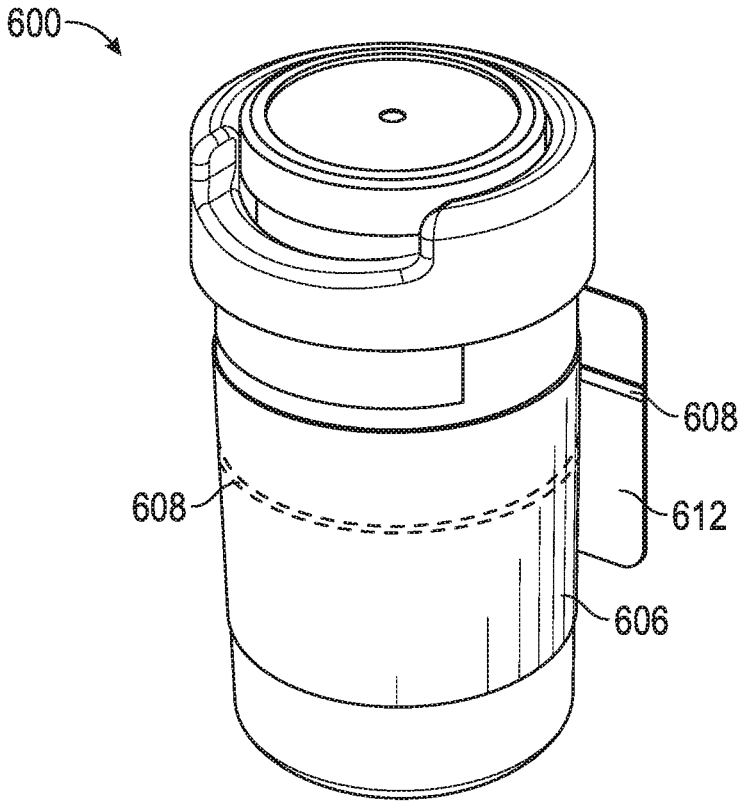
FIG. 6A is a perspective view of sixth example vial and sleeve assembly including a sticker and a sixth example sleeve coupled to the vial of FIG. 1A according to the teachings of the present disclosure.
Figure 6B:
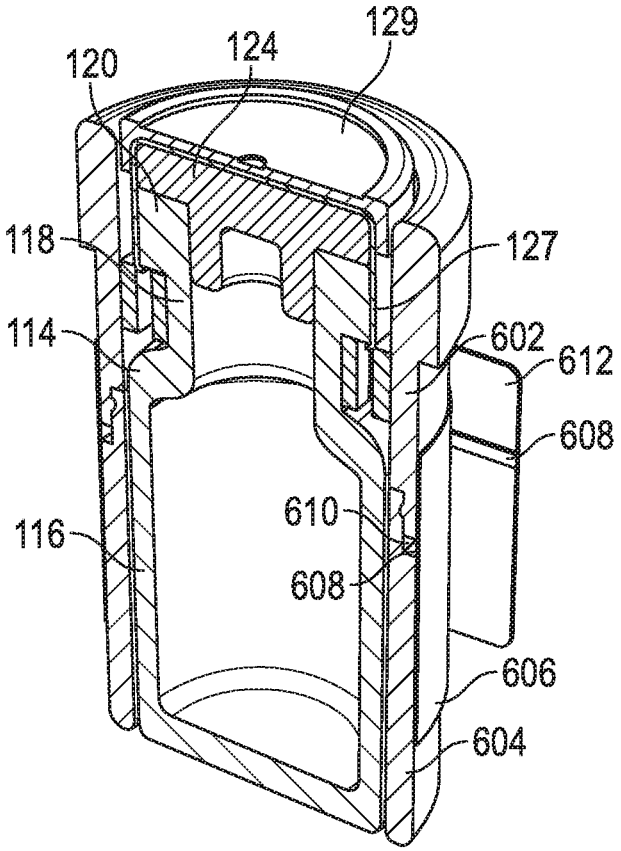
FIG. 6B is a cross-sectional view of the sixth example vial and sleeve assembly of FIG. 6A.
Figure 6C:
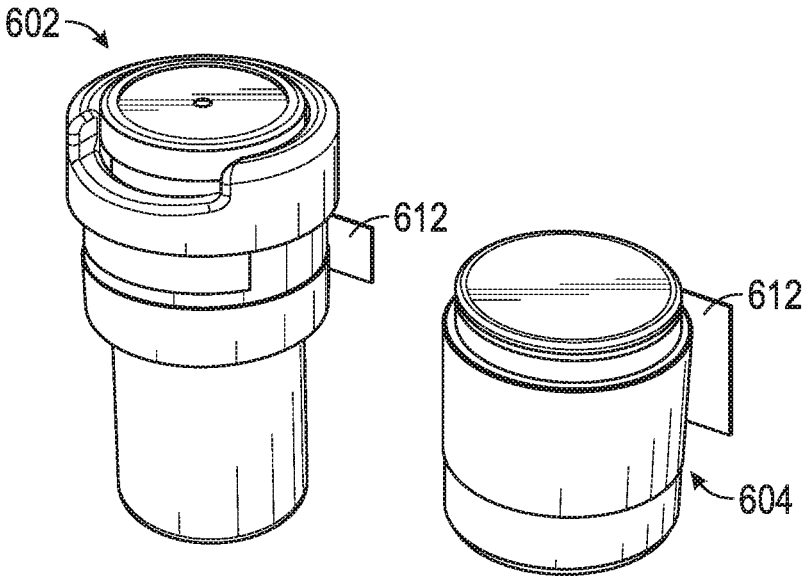
FIG. 6C is a perspective view of the sixth example vial and sleeve assembly of FIG. 6A, illustrating an upper piece of the sixth example sleeve separate from a lower piece of the sleeve.
Figure 6D:
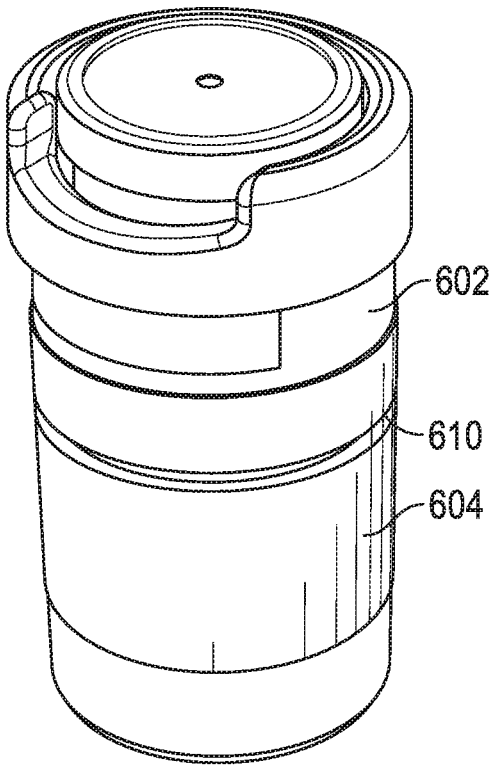
FIG. 6D is a perspective view of the sixth example vial and sleeve assembly of FIG. 6A, illustrating the sixth example sleeve without a sticker.
Figure 6E:
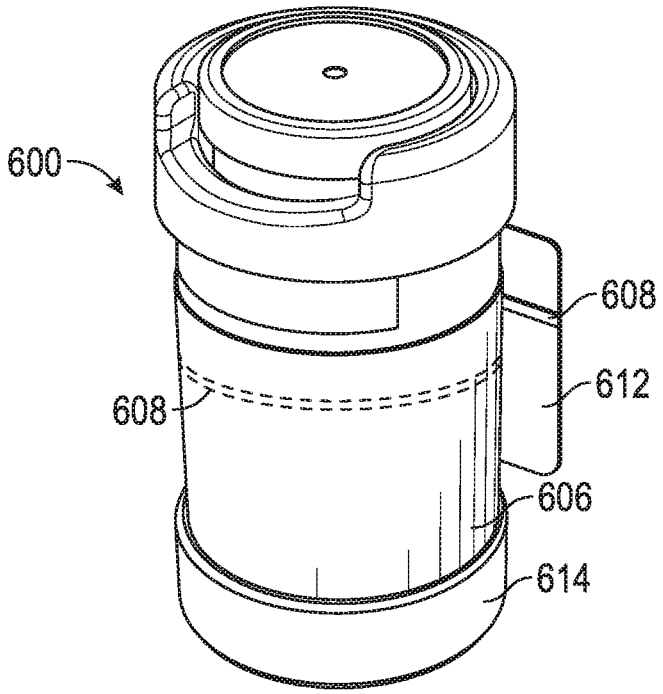
FIG. 6E is a perspective view of the sixth example vial and sleeve assembly of FIG. 6A with a foot extension coupled to the sixth example sleeve.
Figure 6F:
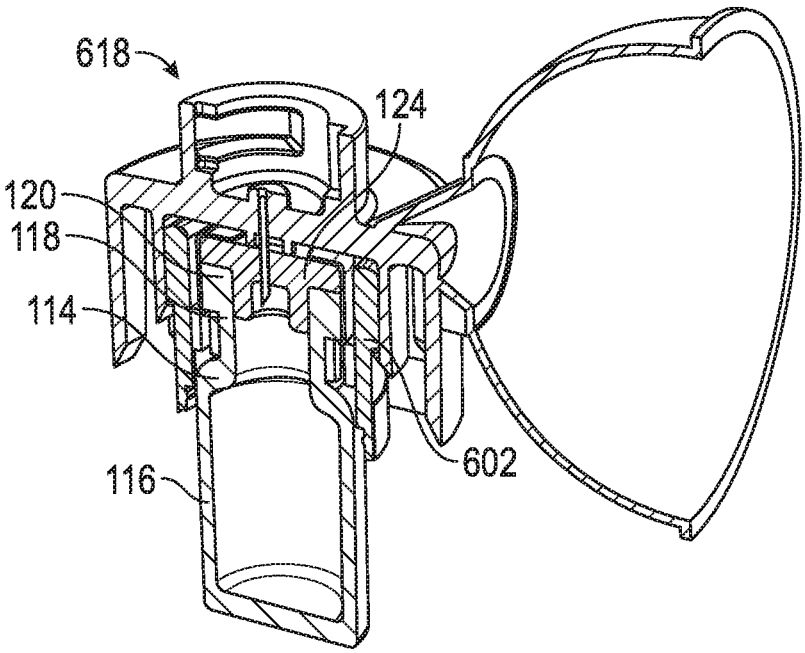
FIG. 6F is a cross-sectional view of the an example closed system transfer device coupled to the sixth example vial and sleeve assembly of FIG. 6A.

FIG. 6C illustrates the sticker 606 and filament 608 removed and the upper and lower pieces 602, 604 separated. FIG. 6E illustrates a foot extension 614 coupled to the lower piece 604 of the sleeve 600, which may have an outer circumference equal to an outer circumference of an outer flange 616 in order to facilitate use with machinery, such as, for example, automated loading machinery, automated thawing machinery, etc. FIG. 6F illustrates the outer flange 616 coupled with a device or adapter, such as, for example, a CSTD 618, which may include or correspond to the CSTD 320 and/or CSTD 408 in some embodiments. In some embodiments, the lower piece 604 may be removed while the upper piece 604 is coupled with the CSTD 618. Thus, thawing may occur while the vial 102 is still coupled with the CSTD 618.

Referring now to a seventh vial and sleeve assembly in FIGS. 7A-7E, a system for securing the vial 102 includes a compressible element 700 and a sleeve 702. In some embodiments, the compressible element 700 includes or corresponds to the compressible element 302 of FIGS. 3A-3H, and the sleeve 702 includes or corresponds to one or more of the following: the sleeve 100, the sleeve 200, the sleeve 300, the sleeve 400, the sleeve 500, and the sleeve 600 of the previous figures.

Figure 7A:
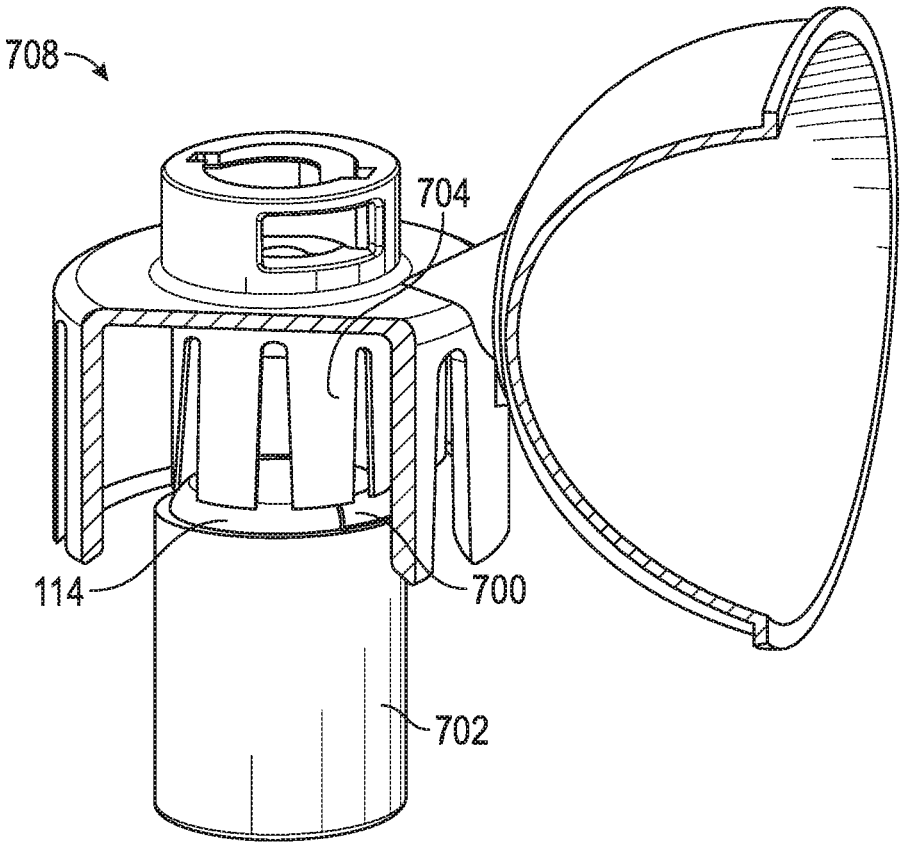
FIG. 7A is an exploded perspective view of an example closed system transfer device, a seventh example sleeve, and a third example compressible element according to the teachings of the present disclosure.
Figure 7B:
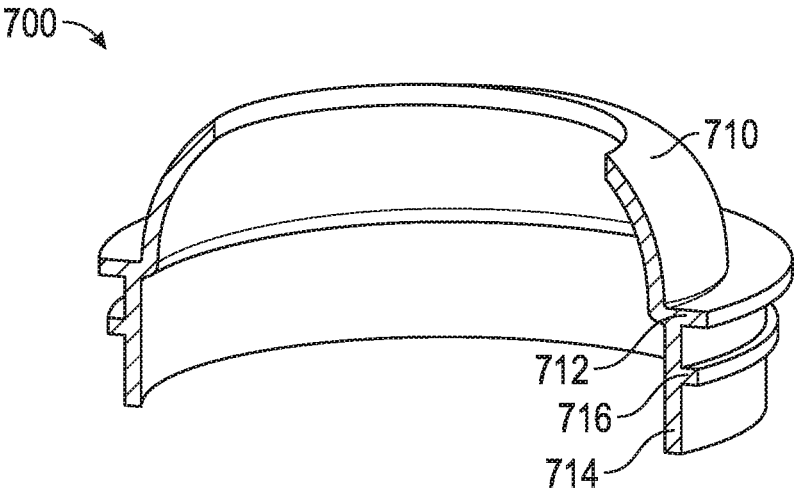
FIG. 7B is a perspective view of the third example compressible element of FIG. 7A.
Figure 7C:
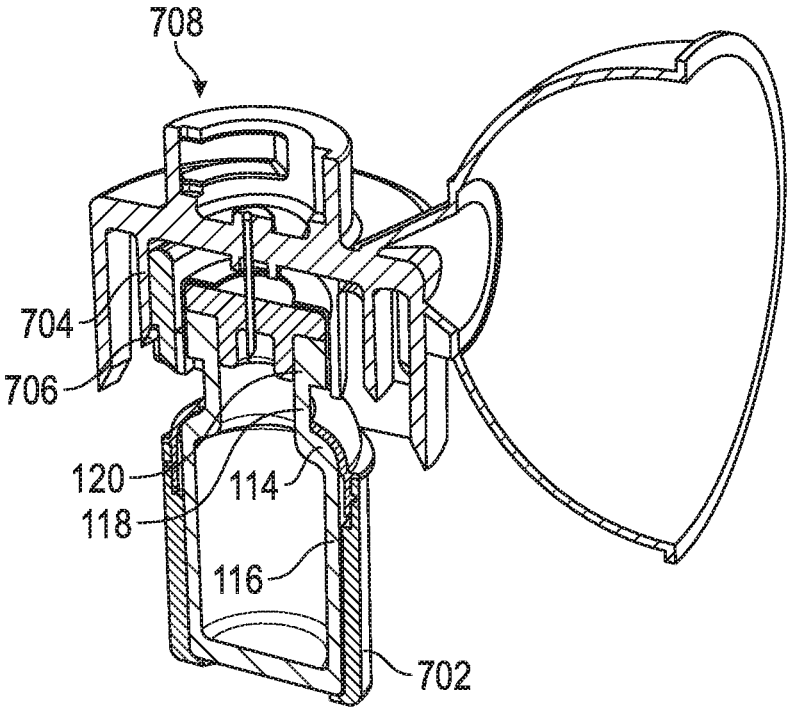
FIG. 7C is a cross-sectional view of the closed system transfer device attached to a seventh example vial and sleeve assembly including the third example compressible element, the seventh example sleeve of FIG. 7A, and the vial of FIG. 1A.

A shown in FIG. 7B, the compressible element 700 is configured to be secured or placed around at least a portion of the shoulder 114 of the vial 102. The compressible element 700 is in a shape of a partial ring and is configured to extend approximately 300 degrees around the vial 102. In some embodiments, the compressible element 700 may be low-profile such that the compressible element 700 does not interfere with and/or contact one or more arms 704 and/or hooks 706 disposed on the arms 704 of a CSTD 708, which may occupy at least a portion of the neck 118 of the vial 102. As shown in FIG. 7C, the hooks 706 may engage with the outwardly extending bottom surface of the top portion of the vial 102 and/or the cap 122.

Figure 7D:
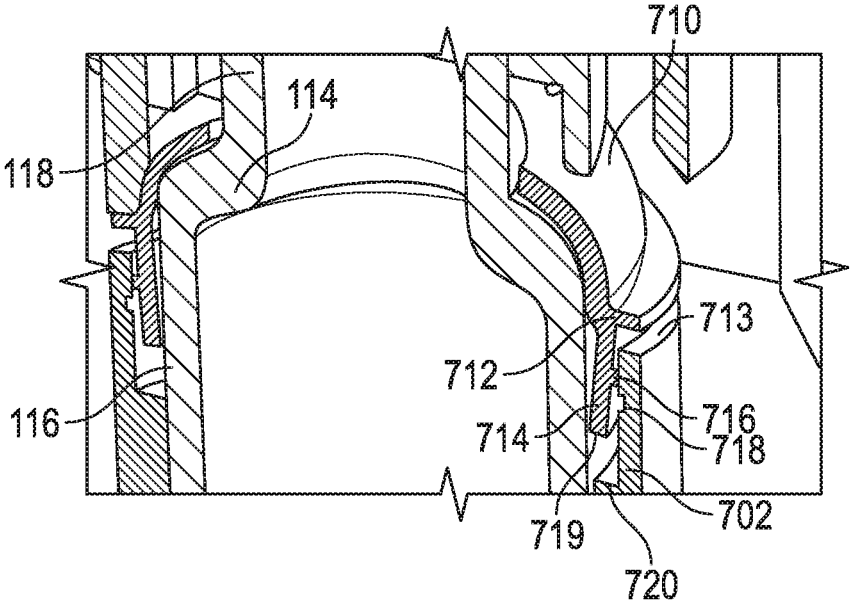
FIG. 7D is an enlarged cross-sectional view of a portion of the seventh example vial and sleeve assembly of FIG. 7C, illustrating the third example compressible element partially inserted into the seventh example sleeve.
Figure 7E:
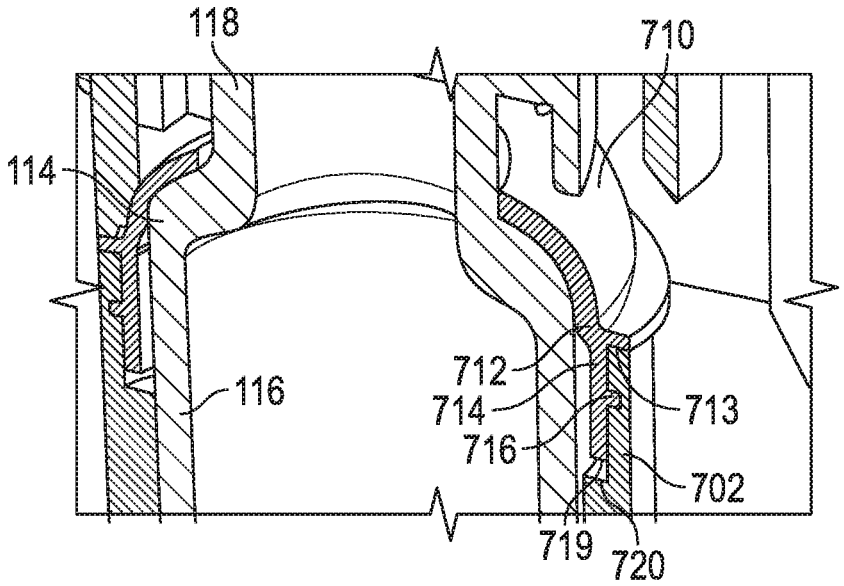
FIG. 7E is an enlarged cross-sectional view of a portion of the seventh example vial and sleeve assembly of FIG. 7C, illustrating the third example compressible element fully inserted into the seventh example sleeve.

In FIG. 7B, the compressible element 700 includes a concave flange portion 710 shaped to correspond to a shape of the shoulder 114 of the vial 102. When the vial 102 and the compressible element 700 are fully inserted within the sleeve 702 as shown in FIGS. 7C and 7E, the flange portion 710 extends around a portion of the shoulder 114 of the vial 102 and may contact the portion of the shoulder 114. In these and other embodiments, the flange portion 710 may contact the shoulder 114 to prevent compression or further compression of the compressible element 700. The compressible element 700 includes a ledge 712, which protrudes outwardly from the flange portion 710. When the compressible element 700 is fully inserted within the sleeve 702, as illustrated in FIG. 7E, the ledge 712 contacts an upper edge 713 of the sleeve 702, which may prevent downward movement of the compressible element 700.

An extension 714 extends downwardly from the ledge 712, and may extend around all or a portion of the lower portion 116 and/or the shoulder 114 of the vial 102. The compressible element 700 may include multiple extensions, and the extension 714 includes a coupling element, which facilitates coupling of the compressible element 700 with an inner surface of the sleeve 702. For example, the extension includes a protrusion 716, which is received into a receiving portion or groove 718 disposed on the inner surface of the sleeve 702. The extension 714 may be flexible, and is configured to move between a first position or configuration and a second position or configuration. When the vial 102 is fully inserted in the sleeve 102 and the compressible element 700 is partially inserted in the sleeve 102, as illustrated in FIG. 7D, the extension 714 is disposed inwardly in the first position. When the extension 714 is disposed in the first position, the protrusion 716 may be offset from the groove 718 and/or contact between the protrusion 716 and the inner surface of the sleeve 102 may bias the extension 714 in the first position.

When the vial 102 is fully inserted in the sleeve 102 and the compressible element 700 is fully inserted in the sleeve 702, as illustrated in FIG. 7E, the extension 714 is disposed in a second position. When the compressible element 700 is fully inserted in the sleeve 702, a bottom edge 719 of the extension 714 may contact a flange 720 of the inner surface of the sleeve 702, which may prevent downward movement of the compressible element 700. When the protrusion 716 is aligned with the groove 718, the extension 714 may resiliently return to the second position after being in the first position.

In some embodiments, an insertion tool or machine may be used to push the sleeve over the vial at room temperature or low temperature, such as, for example, negative 80 degrees C. In some embodiments, the sleeve may be constructed of plastic, metal, a polymer, and/or another suitable material. In some embodiments, the metal may include aluminum. In some embodiments, a material of the sleeve may be sustainable at low temperature to allow the sleeve to function at low temperature. In some embodiments, the sleeve may include a single unitary piece. In other embodiments, the sleeve may include multiple pieces, which may be coupled together. In some embodiments, a tool may be required to secure the vial within the sleeve by engagement of a secondary sleeve part and/or a crimping process.

In some embodiments, the outer flange may be configured to engage with a device, such as, for example, a closed system transfer device ("CSTD"). Various types of CSTDs may be coupled with the sleeve. The CSTD may be used for safe transfer of potentially hazardous contents of the vial and/or may prevent needle sticks. The CSTD may provide a means to make transfers between vials, syringes, and IV bags without exposing the health care professional to the contents. An example of a CSTD may include the PHASEAL™ CSTD commercially available from Becton, Dickinson, and Company.

In some embodiments, the sleeve may be used to label the vial. For example, the sleeve may include a particular color, marking, or other indicator of the contents of the vial. In some embodiments, the color, marking, or other indicator may identify the contents of the vial to an administrator of a blind study but not to a health care professional administering the contents of the vial or a patient receiving the contents of the vial. In some embodiments, the sleeve may hide the contents of the vial and/or a previously applied label on the vial, such as, for example, an adhesive label.

In some embodiments, the health care professional and/or the patient may not be able to remove the vial from the sleeve without evidence of tampering. Thus, in some embodiments, the contents of the vial and/or the label on the vial may not be viewed without evidence of tampering. In some instances, a placebo and experimental drug look the same or similar. In these and other embodiments, the sleeve may include one or more apertures that may allow the health care professional to view an amount of the contents present in the vial. In some embodiments, the sleeve may be configured such that the contents of the vial may be viewed from a top and/or a bottom of the vial.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The above description describes various systems and methods for use with vial sleeve. It should be clear that the system, vial sleeve or methods can further comprise use of a medicament listed below with the caveat that the following list should neither be considered to be all inclusive nor limiting.

For example, the vial may be filled with colony stimulating factors, such as granulocyte colony-stimulating factor (G-CSF). Such G-CSF agents include, but are not limited to, Neupogen® (filgrastim) and Neulasta® (pegfilgrastim). In various other embodiments, the drug delivery device may be used with various pharmaceutical products, such as an erythropoiesis stimulating agent (ESA), which may be in a liquid or a lyophilized form. An ESA is any molecule that stimulates erythropoiesis, such as Epogen® (epoetin alfa), Aranesp® (darbepoetin alfa), Dynepo® (epoetin delta), Mircera® (methyoxy polyethylene glycol-epoetin beta), Hematide®, MRK-2578, INS-22, Retacrit® (epoetin zeta), Neorecormon® (epoetin beta), Silapo® (epoetin zeta), Binocrit® (epoetin alfa), epoetin alfa Hexal, Abseamed® (epoetin alfa), Ratioepo® (epoetin theta), Eporatio® (epoetin theta), Biopoin® (epoetin theta), epoetin alfa, epoetin beta, epoetin zeta, epoetin theta, and epoetin delta, as well as the molecules or variants or analogs thereof as disclosed in the following patents or patent applications, each of which is herein incorporated by reference in its entirety: U.S. Pat. Nos. 4,703,008; 5,441,868; 5,547,933; 5,618,698; 5,621,080; 5,756,349; 5,767,078; 5,773,569; 5,955,422; 5,986,047; 6,583,272; 7,084,245; and 7,271,689; and PCT Publication Nos. WO 91/05867; WO 95/05465; WO 96/40772; WO 00/24893; WO 01/81405; and WO 2007/136752.

An ESA can be an erythropoiesis stimulating protein. As used herein, "erythropoiesis stimulating protein" means any protein that directly or indirectly causes activation of the erythropoietin receptor, for example, by binding to and causing dimerization of the receptor. Erythropoiesis stimulating proteins include erythropoietin and variants, analogs, or derivatives thereof that bind to and activate erythropoietin receptor; antibodies that bind to erythropoietin receptor and activate the receptor; or peptides that bind to and activate erythropoietin receptor. Erythropoiesis stimulating proteins include, but are not limited to, epoetin alfa, epoetin beta, epoetin delta, epoetin omega, epoetin iota, epoetin zeta, and analogs thereof, pegylated erythropoietin, carbamylated erythropoietin, mimetic peptides (including EMP1/hematide), and mimetic antibodies. Exemplary erythropoiesis stimulating proteins include erythropoietin, darbepoetin, erythropoietin agonist variants, and peptides or antibodies that bind and activate erythropoietin receptor (and include compounds reported in U.S. Publication Nos. 2003/0215444 and 2006/0040858, the disclosures of each of which is incorporated herein by reference in its entirety) as well as erythropoietin molecules or variants or analogs thereof as disclosed in the following patents or patent applications, which are each herein incorporated by reference in its entirety: U.S. Pat. Nos. 4,703,008; 5,441,868; 5,547,933; 5,618,698; 5,621,080; 5,756,349; 5,767,078; 5,773,569; 5,955,422; 5,830,851; 5,856,298; 5,986,047; 6,030,086; 6,310,078; 6,391,633; 6,583,272; 6,586,398; 6,900,292; 6,750,369; 7,030,226; 7,084,245; and 7,217,689; U.S. Publication Nos. 2002/0155998; 2003/0077753; 2003/0082749; 2003/0143202; 2004/0009902; 2004/0071694; 2004/0091961; 2004/0143857; 2004/0157293; 2004/0175379; 2004/0175824; 2004/0229318; 2004/0248815; 2004/0266690; 2005/0019914; 2005/0026834; 2005/0096461; 2005/0107297; 2005/0107591; 2005/0124045; 2005/0124564; 2005/0137329; 2005/0142642; 2005/0143292; 2005/0153879; 2005/0158822; 2005/0158832; 2005/0170457; 2005/0181359; 2005/0181482; 2005/0192211; 2005/0202538; 2005/0227289; 2005/0244409; 2006/0088906; and 2006/0111279; and PCT Publication Nos. WO 91/05867; WO 95/05465; WO 99/66054; WO 00/24893; WO 01/81405; WO 00/61637; WO 01/36489; WO 02/014356; WO 02/19963; WO 02/20034; WO 02/49673; WO 02/085940; WO 03/029291; WO 2003/055526; WO 2003/084477; WO 2003/094858; WO 2004/002417; WO 2004/002424; WO 2004/009627; WO 2004/024761; WO 2004/033651; WO 2004/035603; WO 2004/043382; WO 2004/101600; WO 2004/101606; WO 2004/101611; WO 2004/106373; WO 2004/018667; WO 2005/001025; WO 2005/001136; WO 2005/021579; WO 2005/025606; WO 2005/032460; WO 2005/051327; WO 2005/063808; WO 2005/063809; WO 2005/070451; WO 2005/081687; WO 2005/084711; WO 2005/103076; WO 2005/100403; WO 2005/092369; WO 2006/50959; WO 2006/02646; and WO 2006/29094.

Examples of other pharmaceutical products for use with the device may include, but are not limited to, antibodies such as Vectibix® (panitumumab), Xgeva™ (denosumab) and Prolia™ (denosamab); other biological agents such as Enbrel® (etanercept, TNF-receptor/Fc fusion protein, TNF blocker), Neulasta® (pegfilgrastim, pegylated filgastrim, pegylated G-CSF, pegylated hu-Met-G-CSF), Neupogen® (filgrastim, G-CSF, hu-MetG-CSF), and Nplate® (romiplostim); small molecule drugs such as Sensipar® (cinacalcet). The device may also be used with a therapeutic antibody, a polypeptide, a protein or other chemical, such as an iron, for example, ferumoxytol, iron dextrans, ferric glyconate, and iron sucrose. The pharmaceutical product may be in liquid form, or reconstituted from lyophilized form.

Among particular illustrative proteins are the specific proteins set forth below, including fusions, fragments, analogs, variants or derivatives thereof:

OPGL specific antibodies, peptibodies, and related proteins, and the like (also referred to as RANKL specific antibodies, peptibodies and the like), including fully humanized and human OPGL specific antibodies, particularly fully humanized monoclonal antibodies, including but not limited to the antibodies described in PCT Publication No. WO 03/002713, which is incorporated herein in its entirety as to OPGL specific antibodies and antibody related proteins, particularly those having the sequences set forth therein, particularly, but not limited to, those denoted therein: 9H7; 18B2; 2D8; 2E11; 16E1; and 22B3, including the OPGL specific antibodies having either the light chain of SEQ ID NO:2 as set forth therein in FIG. 2 and/or the heavy chain of SEQ ID NO:4, as set forth therein in FIG. 4, each of which is individually and specifically incorporated by reference herein in its entirety fully as disclosed in the foregoing publication;

Myostatin binding proteins, peptibodies, and related proteins, and the like, including myostatin specific peptibodies, particularly those described in U.S. Publication No. 2004/0181033 and PCT Publication No. WO 2004/058988, which are incorporated by reference herein in their entirety particularly in parts pertinent to myostatin specific peptibodies, including but not limited to peptibodies of the mTN8-19 family, including those of SEQ ID NOS:305-351, including TN8-19-1 through TN8-19-40, TN8-19 con1 and TN8-19 con2; peptibodies of the mL2 family of SEQ ID NOS:357-383; the mL15 family of SEQ ID NOS:384-409; the mL17 family of SEQ ID NOS:410-438; the mL20 family of SEQ ID NOS:439-446; the mL21 family of SEQ ID NOS:447-452; the mL24 family of SEQ ID NOS:453-454; and those of SEQ ID NOS:615-631, each of which is individually and specifically incorporated by reference herein in their entirety fully as disclosed in the foregoing publication;

IL-4 receptor specific antibodies, peptibodies, and related proteins, and the like, particularly those that inhibit activities mediated by binding of IL-4 and/or IL-13 to the receptor, including those described in PCT Publication No. WO 2005/047331 or PCT Application No. PCT/US2004/37242 and in U.S. Publication No. 2005/112694, which are incorporated herein by reference in their entirety particularly in parts pertinent to IL-4 receptor specific antibodies, particularly such antibodies as are described therein, particularly, and without limitation, those designated therein: L1H1; L1H2; L1H3; L1H4; L1H5; L1H6; L1H7; L1H8; L1H9; L1H10; L1H11; L2H1; L2H2; L2H3; L2H4; L2H5; L2H6; L2H7; L2H8; L2H9; L2H10; L2H11; L2H12; L2H13; L2H14; L3H1; L4H1; L5H1; L6H1, each of which is individually and specifically incorporated by reference herein in its entirety fully as disclosed in the foregoing publication;

Interleukin 1-receptor 1 ("IL1-R1") specific antibodies, peptibodies, and related proteins, and the like, including but not limited to those described in U.S. Publication No. 2004/097712, which is incorporated herein by reference in its entirety in parts pertinent to IL1-R1 specific binding proteins, monoclonal antibodies in particular, especially, without limitation, those designated therein: 15CA, 26F5, 27F2, 24E12, and 10H7, each of which is individually and specifically incorporated by reference herein in its entirety fully as disclosed in the aforementioned publication;

Ang2 specific antibodies, peptibodies, and related proteins, and the like, including but not limited to those described in PCT Publication No. WO 03/057134 and U.S. Publication No. 2003/0229023, each of which is incorporated herein by reference in its entirety particularly in parts pertinent to Ang2 specific antibodies and peptibodies and the like, especially those of sequences described therein and including but not limited to: L1(N); L1(N) WT; L1(N) 1K WT; 2×L1(N); 2×L1(N) WT; Con4 (N), Con4 (N) 1K WT, 2×Con4 (N) 1K; L1C; L1C 1K; 2×L1C; Con4C; Con4C 1K; 2×Con4C 1K; Con4-L1 (N); Con4-L1C; TN-12-9 (N); C17 (N); TN8-8(N); TN8-14 (N); Con 1 (N), also including anti-Ang 2 antibodies and formulations such as those described in PCT Publication No. WO 2003/030833 which is incorporated herein by reference in its entirety as to the same, particularly Ab526; Ab528; Ab531; Ab533; Ab535; Ab536; Ab537; Ab540; Ab543; Ab544; Ab545; Ab546; A551; Ab553; Ab555; Ab558; Ab559; Ab565; AbF1AbFD; AbFE; AbFJ; AbFK; AbG1D4; AbGC1E8; AbH1C12; AblA1; AbIF; AbIK, AbIP; and AbIP, in their various permutations as described therein, each of which is individually and specifically incorporated by reference herein in its entirety fully as disclosed in the foregoing publication;

NGF specific antibodies, peptibodies, and related proteins, and the like including, in particular, but not limited to those described in U.S. Publication No. 2005/0074821 and U.S. Pat. No. 6,919,426, which are incorporated herein by reference in their entirety particularly as to NGF-specific antibodies and related proteins in this regard, including in particular, but not limited to, the NGF-specific antibodies therein designated 4D4, 4G6, 6H9, 7H2, 14D10 and 14D11, each of which is individually and specifically incorporated by reference herein in its entirety fully as disclosed in the foregoing publication;

CD22 specific antibodies, peptibodies, and related proteins, and the like, such as those described in U.S. Pat. No. 5,789,554, which is incorporated herein by reference in its entirety as to CD22 specific antibodies and related proteins, particularly human CD22 specific antibodies, such as but not limited to humanized and fully human antibodies, including but not limited to humanized and fully human monoclonal antibodies, particularly including but not limited to human CD22 specific IgG antibodies, such as, for instance, a dimer of a human-mouse monoclonal hLL2 gamma-chain disulfide linked to a human-mouse monoclonal hLL2 kappa-chain, including, but limited to, for example, the human CD22 specific fully humanized antibody in Epratuzumab, CAS registry number 501423-23-0;

IGF-1 receptor specific antibodies, peptibodies, and related proteins, and the like, such as those described in PCT Publication No. WO 06/069202, which is incorporated herein by reference in its entirety as to IGF-1 receptor specific antibodies and related proteins, including but not limited to the IGF-1 specific antibodies therein designated L1H1, L2H2, L3H3, L4H4, L5H5, L6H6, L7H7, L8H8, L9H9, L10H10, L11H11, L12H12, L13H13, L14H14, L15H15, L16H16, L17H17, L18H18, L19H19, L20H20, L21H21, L22H22, L23H23, L24H24, L25H25, L26H26, L27H27, L28H28, L29H29, L30H30, L31H31, L32H32, L33H33, L34H34, L35H35, L36H36, L37H37, L38H38, L39H39, L40H40, L41H41, L42H42, L43H43, L44H44, L45H45, L46H46, L47H47, L48H48, L49H49, L50H50, L51H51, L52H52, and IGF-1R-binding fragments and derivatives thereof, each of which is individually and specifically incorporated by reference herein in its entirety fully as disclosed in the foregoing publication;

Also among non-limiting examples of anti-IGF-1R antibodies for use in the methods and compositions of the present invention are each and all of those described in:

(i) U.S. Publication No. 2006/0040358 (published Feb. 23, 2006), 2005/0008642 (published Jan. 13, 2005), 2004/0228859 (published Nov. 18, 2004), including but not limited to, for instance, antibody 1A (DSMZ Deposit No. DSM ACC 2586), antibody 8 (DSMZ Deposit No. DSM ACC 2589), antibody 23 (DSMZ Deposit No. DSM ACC 2588) and antibody 18 as described therein;

(ii) PCT Publication No. WO 06/138729 (published Dec. 28, 2006) and WO 05/016970 (published Feb. 24, 2005), and Lu et al. (2004), J. Biol. Chem. 279:2856-2865, including but not limited to antibodies 2F8, A12, and IMC-A12 as described therein;

(iii) PCT Publication No. WO 07/012614 (published Feb. 1, 2007), WO 07/000328 (published Jan. 4, 2007), WO 06/013472 (published Feb. 9, 2006), WO 05/058967 (published Jun. 30, 2005), and WO 03/059951 (published Jul. 24, 2003);

(iv) U.S. Publication No. 2005/0084906 (published Apr. 21, 2005), including but not limited to antibody 7C10, chimaeric antibody C7C10, antibody h7C10, antibody 7H2M, chimaeric antibody *7C10, antibody GM 607, humanized antibody 7C10 version 1, humanized antibody 7C10 version 2, humanized antibody 7C10 version 3, and antibody 7H2HM, as described therein;

(v) U.S. Publication Nos. 2005/0249728 (published Nov. 10, 2005), 2005/0186203 (published Aug. 25, 2005), 2004/0265307 (published Dec. 30, 2004), and 2003/0235582 (published Dec. 25, 2003) and Maloney et al. (2003), Cancer Res. 63:5073-5083, including but not limited to antibody EM164, resurfaced EM164, humanized EM164, huEM164 v1.0, huEM164 v1.1, huEM164 v1.2, and huEM164 v1.3 as described therein;

(vi) U.S. Pat. No. 7,037,498 (issued May 2, 2006), U.S. Publication Nos. 2005/0244408 (published Nov. 30, 2005) and 2004/0086503 (published May 6, 2004), and Cohen, et al. (2005), Clinical Cancer Res. 11:2063-2073, e.g., antibody CP-751,871, including but not limited to each of the antibodies produced by the hybridomas having the ATCC accession numbers PTA-2792, PTA-2788, PTA-2790, PTA-2791, PTA-2789, PTA-2793, and antibodies 2.12.1, 2.13.2, 2.14.3, 3.1.1, 4.9.2, and 4.17.3, as described therein;

(vii) U.S. Publication Nos. 2005/0136063 (published Jun. 23, 2005) and 2004/0018191 (published Jan. 29, 2004), including but not limited to antibody 19D12 and an antibody comprising a heavy chain encoded by a polynucleotide in plasmid 15H12/19D12 HCA (γ4), deposited at the ATCC under number PTA-5214, and a light chain encoded by a polynucleotide in plasmid 15H12/19D12 LCF (κ), deposited at the ATCC under number PTA-5220, as described therein; and (viii) U.S. Publication No. 2004/0202655 (published Oct. 14, 2004), including but not limited to antibodies PINT-6A1, PINT-7A2, PINT-7A4, PINT-7A5, PINT-7A6, PINT-8A1, PINT-9A2, PINT-11A1, PINT-11A2, PINT-11A3, PINT-11A4, PINT-11A5, PINT-11A7, PINT-11A12, PINT-12A1, PINT-12A2, PINT-12A3, PINT-12A4, and PINT-12A5, as described therein; each and all of which are herein incorporated by reference in their entireties, particularly as to the aforementioned antibodies, peptibodies, and related proteins and the like that target IGF-1 receptors;

B-7 related protein 1 specific antibodies, peptibodies, related proteins and the like ("B7RP-1," also is referred to in the literature as B7H2, ICOSL, B7h, and CD275), particularly B7RP-specific fully human monoclonal IgG2 antibodies, particularly fully human IgG2 monoclonal antibody that binds an epitope in the first immunoglobulin-like domain of B7RP-1, especially those that inhibit the interaction of B7RP-1 with its natural receptor, ICOS, on activated T cells in particular, especially, in all of the foregoing regards, those disclosed in U.S. Publication No. 2008/0166352 and PCT Publication No. WO 07/011941, which are incorporated herein by reference in their entireties as to such antibodies and related proteins, including but not limited to antibodies designated therein as follow: 16H (having light chain variable and heavy chain variable sequences SEQ ID NO:1 and SEQ ID NO:7 respectively therein); 5D (having light chain variable and heavy chain variable sequences SEQ ID NO:2 and SEQ ID NO:9 respectively therein); 2H (having light chain variable and heavy chain variable sequences SEQ ID NO:3 and SEQ ID NO:10 respectively therein); 43H (having light chain variable and heavy chain variable sequences SEQ ID NO:6 and SEQ ID NO:14 respectively therein); 41H (having light chain variable and heavy chain variable sequences SEQ ID NO:5 and SEQ ID NO:13 respectively therein); and 15H (having light chain variable and heavy chain variable sequences SEQ ID NO:4 and SEQ ID NO:12 respectively therein), each of which is individually and specifically incorporated by reference herein in its entirety fully as disclosed in the foregoing publication;

IL-15 specific antibodies, peptibodies, and related proteins, and the like, such as, in particular, humanized monoclonal antibodies, particularly antibodies such as those disclosed in U.S. Publication Nos. 2003/0138421; 2003/023586; and 2004/0071702; and U.S. Pat. No. 7,153,507, each of which is incorporated herein by reference in its entirety as to IL-15 specific antibodies and related proteins, including peptibodies, including particularly, for instance, but not limited to, HuMax IL-15 antibodies and related proteins, such as, for instance, 146B7;

IFN gamma specific antibodies, peptibodies, and related proteins and the like, especially human IFN gamma specific antibodies, particularly fully human anti-IFN gamma antibodies, such as, for instance, those described in U.S. Publication No. 2005/0004353, which is incorporated herein by reference in its entirety as to IFN gamma specific antibodies, particularly, for example, the antibodies therein designated 1118; 1118*; 1119; 1121; and 1121*. The entire sequences of the heavy and light chains of each of these antibodies, as well as the sequences of their heavy and light chain variable regions and complementarity determining regions, are each individually and specifically incorporated by reference herein in its entirety fully as disclosed in the foregoing publication and in Thakur et al. (1999), Mol. Immunol. 36:1107-1115. In addition, description of the properties of these antibodies provided in the foregoing publication is also incorporated by reference herein in its entirety. Specific antibodies include those having the heavy chain of SEQ ID NO:17 and the light chain of SEQ ID NO:18; those having the heavy chain variable region of SEQ ID NO:6 and the light chain variable region of SEQ ID NO:8; those having the heavy chain of SEQ ID NO:19 and the light chain of SEQ ID NO:20; those having the heavy chain variable region of SEQ ID NO:10 and the light chain variable region of SEQ ID NO:12; those having the heavy chain of SEQ ID NO:32 and the light chain of SEQ ID NO:20; those having the heavy chain variable region of SEQ ID NO:30 and the light chain variable region of SEQ ID NO:12; those having the heavy chain sequence of SEQ ID NO:21 and the light chain sequence of SEQ ID NO:22; those having the heavy chain variable region of SEQ ID NO:14 and the light chain variable region of SEQ ID NO:16; those having the heavy chain of SEQ ID NO:21 and the light chain of SEQ ID NO:33; and those having the heavy chain variable region of SEQ ID NO:14 and the light chain variable region of SEQ ID NO:31, as disclosed in the foregoing publication. A specific antibody contemplated is antibody 1119 as disclosed in the foregoing U.S. publication and having a complete heavy chain of SEQ ID NO:17 as disclosed therein and having a complete light chain of SEQ ID NO:18 as disclosed therein;

TALL-1 specific antibodies, peptibodies, and the related proteins, and the like, and other TALL specific binding proteins, such as those described in U.S. Publication Nos. 2003/0195156 and 2006/0135431, each of which is incorporated herein by reference in its entirety as to TALL-1 binding proteins, particularly the molecules of Tables 4 and 5B, each of which is individually and specifically incorporated by reference herein in its entirety fully as disclosed in the foregoing publications;

Parathyroid hormone ("PTH") specific antibodies, peptibodies, and related proteins, and the like, such as those described in U.S. Pat. No. 6,756,480, which is incorporated herein by reference in its entirety, particularly in parts pertinent to proteins that bind PTH;

Thrombopoietin receptor ("TPO-R") specific antibodies, peptibodies, and related proteins, and the like, such as those described in U.S. Pat. No. 6,835,809, which is herein incorporated by reference in its entirety, particularly in parts pertinent to proteins that bind TPO-R;

Hepatocyte growth factor ("HGF") specific antibodies, peptibodies, and related proteins, and the like, including those that target the HGF/SF:cMet axis (HGF/SF:c-Met), such as the fully human monoclonal antibodies that neutralize hepatocyte growth factor/scatter (HGF/SF) described in U.S. Publication No. 2005/0118643 and PCT Publication No. WO 2005/017107, huL2G7 described in U.S. Pat. No. 7,220,410 and OA-5d5 described in U.S. Pat. Nos. 5,686,292 and 6,468,529 and in PCT Publication No. WO 96/38557, each of which is incorporated herein by reference in its entirety, particularly in parts pertinent to proteins that bind HGF;

TRAIL-R2 specific antibodies, peptibodies, related proteins and the like, such as those described in U.S. Pat. No. 7,521,048, which is herein incorporated by reference in its entirety, particularly in parts pertinent to proteins that bind TRAIL-R2;

Activin A specific antibodies, peptibodies, related proteins, and the like, including but not limited to those described in U.S. Publication No. 2009/0234106, which is herein incorporated by reference in its entirety, particularly in parts pertinent to proteins that bind Activin A;

TGF-beta specific antibodies, peptibodies, related proteins, and the like, including but not limited to those described in U.S. Pat. No. 6,803,453 and U.S. Publication No. 2007/0110747, each of which is herein incorporated by reference in its entirety, particularly in parts pertinent to proteins that bind TGF-beta;

Amyloid-beta protein specific antibodies, peptibodies, related proteins, and the like, including but not limited to those described in PCT Publication No. WO 2006/081171, which is herein incorporated by reference in its entirety, particularly in parts pertinent to proteins that bind amyloid-beta proteins. One antibody contemplated is an antibody having a heavy chain variable region comprising SEQ ID NO:8 and a light chain variable region having SEQ ID NO:6 as disclosed in the foregoing publication;

c-Kit specific antibodies, peptibodies, related proteins, and the like, including but not limited to those described in U.S. Publication No. 2007/0253951, which is incorporated herein by reference in its entirety, particularly in parts pertinent to proteins that bind c-Kit and/or other stem cell factor receptors;

OX40L specific antibodies, peptibodies, related proteins, and the like, including but not limited to those described in U.S. Publication No. 2006/0002929, which is incorporated herein by reference in its entirety, particularly in parts pertinent to proteins that bind OX40L and/or other ligands of the OX40 receptor; and Other exemplary proteins, including Activase® (alteplase, tPA); Aranesp® (darbepoetin alfa); Epogen® (epoetin alfa, or erythropoietin); GLP-1, Avonex® (interferon beta-1a); Bexxar® (tositumomab, anti-CD22 monoclonal antibody); Betaseron® (interferon-beta); Campath® (alemtuzumab, anti-CD52 monoclonal antibody); Dynepo® (epoetin delta); Velcade® (bortezomib); MLN0002 (anti-α4β7 mAb); MLN1202 (anti-CCR2 chemokine receptor mAb); Enbrel® (etanercept, TNF-receptor/Fc fusion protein, TNF blocker); Eprex® (epoetin alfa); Erbitux® (cetuximab, anti-EGFR/HER1/c-ErbB-1); Genotropin® (somatropin, Human Growth Hormone); Herceptin® (trastuzumab, anti-HER2/neu (erbB2) receptor mAb); Humatrope® (somatropin, Human Growth Hormone); Humira® (adalimumab); insulin in solution; Infergen® (interferon alfacon-1); Natrecor® (nesiritide; recombinant human B-type natriuretic peptide (hBNP); Kineret® (anakinra); Leukine® (sargamostim, rhuGM-CSF); LymphoCide® (epratuzumab, anti-CD22 mAb); Benlysta™ (lymphostat B, belimumab, anti-BlyS mAb); Metalyse® (tenecteplase, t-PA analog); Mircera® (methoxy polyethylene glycol-epoetin beta); Mylotarg® (gemtuzumab ozogamicin); Raptiva® (efalizumab); Cimzia® (certolizumab pegol, CDP 870); Soliris™ (eculizumab); pexelizumab (anti-C5 complement); Numax® (MEDI-524); Lucentis® (ranibizumab); Panorex® (17-1A, edrecolomab); Trabio® (lerdelimumab); TheraCim hR3 (nimotuzumab); Omnitarg (pertuzumab, 2C4); Osidem® (IDM-1); OvaRex® (B43.13); Nuvion® (visilizumab); cantuzumab mertansine (huC242-DM1); NeoRecormon® (epoetin beta); Neumega® (oprelvekin, human interleukin-11); Neulasta® (pegylated filgastrim, pegylated G-CSF, pegylated hu-Met-G-CSF); Neupogen® (filgrastim, G-CSF, hu-MetG-CSF); Orthoclone OKT3® (muromonab-CD3, anti-CD3 monoclonal antibody); Procrit® (epoetin alfa); Remicade® (infliximab, anti-TNFα monoclonal antibody); Reopro® (abciximab, anti-GP IIb/IIIa receptor monoclonal antibody); Actemra® (anti-IL6 Receptor mAb); Avastin® (bevacizumab), HuMax-CD4 (zanolimumab); Rituxan® (rituximab, anti-CD20 mAb); Tarceva® (erlotinib); Roferon-A®-(interferon alfa-2a); Simulect® (basiliximab); Prexige® (lumiracoxib); Synagis® (palivizumab); 146B7-CHO (anti-IL15 antibody, see U.S. Pat. No. 7,153,507); Tysabri® (natalizumab, anti-α4integrin mAb); Valortim® (MDX-1303, anti-*B. anthracis* protective antigen mAb); ABthrax™; Vectibix® (panitumumab); Xolair® (omalizumab); ETI211 (anti-MRSA mAb); IL-1 trap (the Fc portion of human IgG1 and the extracellular domains of both IL-1 receptor components (the Type I receptor and receptor accessory protein)); VEGF trap (Ig domains of VEGFR1 fused to IgG1 Fc); Zenapax® (daclizumab); Zenapax® (daclizumab, anti-IL-2Rα mAb); Zevalin® (ibritumomab tiuxetan); Zetia® (ezetimibe); Orencia® (atacicept, TACI-Ig); anti-CD80 monoclonal antibody (galiximab); anti-CD23 mAb (lumiliximab); BR2-Fc (huBR3/huFc fusion protein, soluble BAFF antagonist); CNTO 148 (golimumab, anti-TNFα mAb); HGS-ETR1 (mapatumumab; human anti-TRAIL Receptor-1 mAb); HuMax-CD20 (ocrelizumab, anti-CD20 human mAb); HuMax-EGFR (zalutumumab); M200 (volociximab, anti-α5β1 integrin mAb); MDX-010 (ipilimumab, anti-CTLA-4 mAb and VEGFR-1 (IMC-18F1); anti-BR3 mAb; anti-*C. difficile* Toxin A and Toxin B C mAbs MDX-066 (CDA-1) and MDX-1388); anti-CD22 dsFv-PE38 conjugates (CAT-3888 and CAT-8015); anti-CD25 mAb (HuMax-TAC); anti-CD3 mAb (NI-0401); adecatumumab; anti-CD30 mAb (MDX-060); MDX-1333 (anti-IFNAR); anti-CD38 mAb (HuMax CD38); anti-CD40L mAb; anti-Cripto mAb; anti-CTGF Idiopathic Pulmonary Fibrosis Phase I Fibrogen (FG-3019); anti-CTLA4 mAb; anti-eotaxin1 mAb (CAT-213); anti-FGF8 mAb; anti-ganglioside GD2 mAb; anti-ganglioside GM2 mAb; anti-GDF-8 human mAb (MYO-029); anti-GM-CSF Receptor mAb (CAM-3001); anti-HepC mAb (HuMax HepC); anti-IFNα mAb (MEDI-545, MDX-1103); anti-IGF1R mAb; anti-IGF-1R mAb (HuMax-Inflam); anti-IL12 mAb (ABT-874); anti-IL12/1L23 mAb (CNTO 1275); anti-IL13 mAb (CAT-354); anti-IL2Ra mAb (HuMax-TAC); anti-IL5 Receptor mAb; anti-integrin receptors mAb (MDX-018, CNTO 95); anti-IP10 Ulcerative Colitis mAb (MDX-1100); anti-LLY antibody; BMS-66513; anti-Mannose Receptor/hCGβ mAb (MDX-1307); anti-mesothelin dsFv-PE38 conjugate (CAT-5001); anti-PD1mAb (MDX-1106 (ONO-4538)); anti-PDGFRα antibody (IMC-3G3); anti-TGFβ mAb (GC-1008); anti-TRAIL Receptor-2 human mAb (HGS-ETR2); anti-TWEAK mAb; anti-VEGFR/Flt-1 mAb; anti-ZP3 mAb (HuMax-ZP3); NVS Antibody #1; and NVS Antibody #2.

Also included can be a sclerostin antibody, such as but not limited to romosozumab, blosozumab, or BPS 804 (Novartis). Further included can be therapeutics such as rilotumumab, bixalomer, trebananib, ganitumab, conatumumab, motesanib diphosphate, brodalumab, vidupiprant, panitumumab, denosumab, NPLATE, PROLIA, VECTIBIX or XGEVA. Additionally, included in the device can be a monoclonal antibody (IgG) that binds human Proprotein Convertase Subtilisin/Kexin Type 9 (PCSK9), e.g. U.S. Pat. No. 8,030,547, U.S. Publication No. 2013/0064825, WO2008/057457, WO2008/057458, WO2008/057459, WO2008/063382, WO2008/133647, WO2009/100297, WO2009/100318, WO2011/037791, WO2011/053759, WO2011/053783, WO2008/125623, WO2011/072263, WO2009/055783, WO2012/0544438, WO2010/029513, WO2011/111007, WO2010/077854, WO2012/088313, WO2012/101251, WO2012/101252, WO2012/101253, WO2012/109530, and WO2001/031007.

Also included can be talimogene laherparepvec (e.g., IMLYGIC®) or another oncolytic HSV for the treatment of melanoma or other cancers. Examples of oncolytic HSV include, but are not limited to talimogene laherparepvec (U.S. Pat. Nos. 7,223,593 and 7,537,924); OncoVEXGALV/CD (U.S. Pat. No. 7,981,669); OrienX010 (Lei et al. (2013), World J. Gastroenterol., 19:5138-5143); G207, 1716; NV1020; NV12023; NV1034 and NV1042 (Vargehes et al. (2002), Cancer Gene Ther., 9(12):967-978).

Also included are TIMPs. TIMPs are endogenous tissue inhibitors of metalloproteinases (TIMPs) and are important in many natural processes. TIMP-3 is expressed by various cells or and is present in the extracellular matrix; it inhibits all the major cartilage-degrading metalloproteases, and may play a role in role in many degradative diseases of connective tissue, including rheumatoid arthritis and osteoarthritis, as well as in cancer and cardiovascular conditions. The amino acid sequence of TIMP-3, and the nucleic acid sequence of a DNA that encodes TIMP-3, are disclosed in U.S. Pat. No. 6,562,596, issued May 13, 2003, the disclosure of which is incorporated by reference herein. Description of TIMP mutations can be found in U.S. Publication No. 2014/0274874 and PCT Publication No. WO 2014/152012.

Also included are antagonistic antibodies for human calcitonin gene-related peptide (CGRP) receptor and bispecific antibody molecule that target the CGRP receptor and other headache targets. Further information concerning these molecules can be found in PCT Application No. WO 2010/075238.

Additionally, a bispecific T cell engager antibody (BiTe), e.g. Blinotumomab can be used in the device. Alternatively, included can be an APJ large molecule agonist e.g., apelin or analogues thereof in the device. Information relating to such molecules can be found in PCT Publication No. WO 2014/099984.

In certain embodiments, the medicament comprises a therapeutically effective amount of an anti-thymic stromal lymphopoietin (TSLP) or TSLP receptor antibody. Examples of anti-TSLP antibodies that may be used in such embodiments include, but are not limited to, those described in U.S. Pat. Nos. 7,982,016, and 8,232,372, and U.S. Publication No. 2009/0186022. Examples of anti-TSLP receptor antibodies include, but are not limited to, those described in U.S. Pat. No. 8,101,182. In particularly preferred embodiments, the medicament comprises a therapeutically effective amount of the anti-TSLP antibody designated as A5 within U.S. Pat. No. 7,982,016.

Although the vial sleeve, systems, methods, and elements thereof, have been described in terms of exemplary embodiments, they are not limited thereto. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent that would still fall within the scope of the claims defining the invention.

It should be understood that the legal scope of the invention is defined by the words of the claims set forth at the end of this patent. The appended claims should be construed broadly to include other variants and embodiments of same, which may be made by those skilled in the art without departing from the scope and range of equivalents of the vial sleeve, mechanisms, systems, methods, and their elements.

What is claimed:

1. A sleeve for securing a vial, the sleeve comprising:

a cylindrical body sized to receive a vial, the cylindrical body including a central longitudinal axis, a first end, and a second end; and a deformable member disposed near the first end of the cylindrical body and arranged to deform from a first configuration to a second configuration upon insertion of a vial into the cylindrical body, the deformable member including a finger extending upward from the first end of the cylindrical body in each of the first configuration and the second configuration, a tip, and a bent knuckle portion positioned between and connecting the finger and the tip; and wherein the deformable member is displaced radially outwardly relative to the central longitudinal axis of the cylindrical body in the second configuration.

2. The sleeve of claim 1, wherein the tip is angled inwardly relative to the central longitudinal axis of the cylindrical body, and wherein the tip and finger form a hook oriented inwardly relative to the central longitudinal axis.

3. The sleeve of claim 2, wherein the finger flexes outwardly relative to the central longitudinal axis when the deformable member is in the second configuration.

4. The sleeve of claim 3, wherein the tip is outwardly displaced relative to the central longitudinal axis, the tip pivots about the bent knuckle portion toward an inner surface of the cylindrical body when the deformable member is in the second configuration.

5. The sleeve of claim 1, comprising a plurality of deformable members disposed near the first end of the cylindrical body, the plurality of deformable members arranged to engage a shoulder portion of the vial when the vial is fully inserted into the cylindrical body.

6. The sleeve of claim 1, wherein the second end is partially open.

7. The sleeve of claim 2, further comprising a plurality of fingers, wherein the fingers are evenly spaced apart from each other;

wherein prior to insertion of the vial into the cylindrical body, each of the plurality of fingers is disposed in the first configuration;

wherein in response to the vial being partially inserted into the cylindrical body, each of the plurality of fingers is biased outwardly to the second configuration; and wherein in response to the vial being fully inserted into the cylindrical body, each of the plurality of fingers is configured to resiliently return to the first configuration, contacting a shoulder of the vial and trapping the vial within the cylindrical body.

8. The sleeve of claim 7, wherein the bent knuckle portion is bent at less than ninety degrees.

9. The sleeve of claim 7, comprising a closed bottom of the cylindrical body such that the vial may not exit the bottom of the cylindrical body.

10. A vial and sleeve assembly, the assembly comprising:

a vial including a top portion, a bottom portion having a reservoir, a neck connected to the top portion, and a shoulder connecting the neck to the bottom portion;

a sleeve including a cylindrical body sized to receive the bottom portion of vial, the cylindrical body including a central longitudinal axis, a first end, and a second end, the sleeve being adapted to removably connect to the vial;

a deformable member disposed near the first end of the cylindrical body and arranged to deform from a first configuration to a second configuration upon insertion of the vial into the cylindrical body, the deformable member including a finger extending upward from the first end of the cylindrical body in each of the first configuration and the second configuration, a tip, and a bent knuckle portion positioned between and connecting the finger and the tip; and wherein the deformable member is displaced radially outwardly relative to the central longitudinal axis of the cylindrical body in the second configuration, the deformable member being adapted to engage with the vial.

11. The vial and sleeve assembly of claim 10, wherein the deformable member is disposed on the cylindrical body such that the deformable member is aligned with the neck of the vial when the vial is fully inserted into the sleeve.

12. The vial and sleeve assembly of claim 10, wherein the tip comprises an inwardly disposed tip adapted to engage an outer surface of bottom portion of the vial when the vial is partially inserted into the sleeve.

13. The vial and sleeve assembly of claim 12, wherein the tip of the deformable member is disposed adjacent to the neck of the vial in the first configuration when the vial is fully inserted into the sleeve.

14. The vial and sleeve assembly of claim 10, wherein the tip is angled inwardly relative to the central longitudinal axis of the cylindrical body, and wherein the tip and finger form a hook oriented inwardly relative to the central longitudinal axis and arranged to engage the shoulder portion of the vial when the vial is fully inserted into the sleeve.

15. The vial and sleeve assembly of claim 14, wherein when the vial is partially inserted into the sleeve, the finger flexes outwardly relative to the central longitudinal axis and the deformable member is in the second configuration.

16. The vial and sleeve assembly of claim 14, wherein the tip flexes inwardly and pivots about the knuckle and toward the inner surface of the cylindrical body when the deformable member is in the second configuration.

17. The vial and sleeve assembly of claim 10, comprising a plurality of deformable members arranged near the first end of the cylindrical body, the plurality of deformable members arranged to engage the shoulder of the vial when the vial is fully inserted into the sleeve.

18. A method for labeling a vial under cryogenic conditions, the method comprising:

inserting a cryogenically frozen vial into an opening of a sleeve having a body comprising a cylindrical inner surface configured to receive a lower portion of the vial.

19. The method of claim 18, wherein inserting the vial into the sleeve comprises deforming one or more surfaces of the sleeve upon insertion of the vial.

20. The method of claim 18, wherein inserting the vial into the sleeve comprises biasing one or more fingers extending upwardly from an upper edge of the opening, wherein each of the fingers includes a bent portion, and are spaced apart from each other, and wherein prior to insertion of the vial into the sleeve, each of the fingers is disposed in a first position, wherein in response to the vial being partially inserted into the body, each of the fingers is biased outwardly to a second position, wherein in response to the vial being fully inserted into the body, each of the fingers is configured to resiliently return to the first position, contacting a shoulder of the vial and trapping the vial within the body.

* * * * *